US006417824B1

(12) United States Patent
Tokunaga et al.

(10) Patent No.: US 6,417,824 B1
(45) Date of Patent: Jul. 9, 2002

(54) METHOD OF DRIVING PLASMA DISPLAY PANEL

(75) Inventors: Tsutomu Tokunaga; Nobuhiko Saegusa, both of Nakakoma-gun (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/487,723

(22) Filed: Jan. 19, 2000

(30) Foreign Application Priority Data

Jan. 22, 1999 (JP) ..... 11-014328
Apr. 2, 1999 (JP) ..... 11-096888

(51) Int. Cl.[7] ..... G09G 3/36
(52) U.S. Cl. ..... 345/60; 345/93
(58) Field of Search ..... 345/60, 65, 204, 345/690, 691, 693

(56) References Cited

U.S. PATENT DOCUMENTS 5,724,053 A * 3/1998 Nagakubo ..... 345/60
5,757,343 A * 5/1998 Nagakubo ..... 345/63

* cited by examiner

*Primary Examiner*—Vijay Shankar
*Assistant Examiner*—Nitin Patel
(74) *Attorney, Agent, or Firm*—Sughrue Mion, PLLC

(57) ABSTRACT

A method of driving a plasma display panel for improving the contrast at low power consumption while suppressing spurious borders, and for stabilizing selective discharge to improve the display quality. The method selects either a first mode in which the number of times of light emission in a light emission sustaining stage in each subfield (SF) within a SF group in one field display period is set to a first value, or a second mode in which the number of times of light emission in the light emission sustaining stage in each SF within the SF group is set to a second value lower than the first value. When the second mode is selected, at least one of the values of a pulse width and a pulse voltage of a scanning pulse in each SF within the SF group is set larger than the corresponding value of the pulse width or the pulse voltage of the scanning pulse in each SF within the SF group when the first mode is selected.

32 Claims, 27 Drawing Sheets

FIG. 7

| LC | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| FIRST MODE | 4 | 12 | 20 | 32 | 40 | 52 | 64 | 76 | 88 | 100 | 112 | 128 | 140 | 156 |
| SECOND MODE | 3 | 9 | 15 | 24 | 30 | 39 | 48 | 57 | 66 | 75 | 84 | 96 | 105 | 117 |

FIG. 9

| LUMINANCE | DBL | LUMINANCE | HDP | LUMINANCE | DBL | LUMINANCE | HDP |
|---|---|---|---|---|---|---|---|
| | 0 ~ 7 | | 0 ~ 7 | | 0 ~ 7 | | 0 ~ 7 |
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG.10

| LUMINANCE | DBL 0 ~ 7 | LUMINANCE | HDP 0 ~ 7 | LUMINANCE | DBL 0 ~ 7 | LUMINANCE | HDP 0 ~ 7 |
|---|---|---|---|---|---|---|---|
| 128 | 10000000 | 112 | 01110000 | 192 | 11000000 | 168 | 10101000 |
| 129 | 10000001 | 113 | 01110001 | 193 | 11000001 | 169 | 10101001 |
| 130 | 10000010 | 114 | 01110010 | 194 | 11000010 | 170 | 10101010 |
| 131 | 10000011 | 115 | 01110011 | 195 | 11000011 | 171 | 10101011 |
| 132 | 10000100 | 115 | 01110011 | 196 | 11000100 | 172 | 10101100 |
| 133 | 10000101 | 116 | 01110100 | 197 | 11000101 | 173 | 10101101 |
| 134 | 10000110 | 117 | 01110101 | 198 | 11000110 | 173 | 10101101 |
| 135 | 10000111 | 118 | 01110110 | 199 | 11000111 | 174 | 10101110 |
| 136 | 10001000 | 119 | 01110111 | 200 | 11001000 | 175 | 10101111 |
| 137 | 10001001 | 120 | 01111000 | 201 | 11001001 | 176 | 10110000 |
| 138 | 10001010 | 121 | 01111001 | 202 | 11001010 | 177 | 10110001 |
| 139 | 10001011 | 122 | 01111010 | 203 | 11001011 | 178 | 10110010 |
| 140 | 10001100 | 122 | 01111010 | 204 | 11001100 | 179 | 10110011 |
| 141 | 10001101 | 123 | 01111011 | 205 | 11001101 | 180 | 10110100 |
| 142 | 10001110 | 124 | 01111100 | 206 | 11001110 | 180 | 10110100 |
| 143 | 10001111 | 125 | 01111101 | 207 | 11001111 | 181 | 10110101 |
| 144 | 10010000 | 126 | 01111110 | 208 | 11010000 | 182 | 10110110 |
| 145 | 10010001 | 127 | 01111111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11010000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 11110000 | 210 | 11010010 |
| 177 | 10110001 | 155 | 10011011 | 241 | 11110001 | 211 | 11010011 |
| 178 | 10110010 | 156 | 10011100 | 242 | 11110010 | 212 | 11010100 |
| 179 | 10110011 | 157 | 10011101 | 243 | 11110011 | 213 | 11010101 |
| 180 | 10110100 | 158 | 10011110 | 244 | 11110100 | 214 | 11010110 |
| 181 | 10110101 | 158 | 10011110 | 245 | 11110101 | 215 | 11010111 |
| 182 | 10110110 | 159 | 10011111 | 246 | 11110110 | 216 | 11011000 |
| 183 | 10110111 | 160 | 10100000 | 247 | 11110111 | 216 | 11011000 |
| 184 | 10111000 | 161 | 10100001 | 248 | 11111000 | 217 | 11011001 |
| 185 | 10111001 | 162 | 10100010 | 249 | 11111001 | 218 | 11011010 |
| 186 | 10111010 | 163 | 10100011 | 250 | 11111010 | 219 | 11011011 |
| 187 | 10111011 | 164 | 10100100 | 251 | 11111011 | 220 | 11011100 |
| 188 | 10111100 | 165 | 10100101 | 252 | 11111100 | 221 | 11011101 |
| 189 | 10111101 | 166 | 10100110 | 253 | 11111101 | 222 | 11011110 |
| 190 | 10111110 | 166 | 10100110 | 254 | 11111110 | 223 | 11011111 |
| 191 | 10111111 | 167 | 10100111 | 255 | 11111111 | 224 | 11100000 |

FIG.13

[SELECTIVE ERASURE]

| | SF1 | SF2 | SF3 | SF4 | SF5 | SF6 | SF7 | SF8 | SF9 | SF10 | SF11 | SF12 | SF13 | SF14 | LUMINANCE OF LIGHT EMISSION: FIRST MODE | LUMINANCE OF LIGHT EMISSION: SECOND MODE |
|---|---|---|---|---|---|---|---|---|---|---|---|---|---|---|---|---|
| 1 | ● | | | | | | | | | | | | | | 0 | 0 |
| 2 | ○ | ● | | | | | | | | | | | | | 4 | 3 |
| 3 | ○ | ○ | ● | | | | | | | | | | | | 16 | 12 |
| 4 | ○ | ○ | ○ | ● | | | | | | | | | | | 36 | 27 |
| 5 | ○ | ○ | ○ | ○ | ● | | | | | | | | | | 68 | 51 |
| 6 | ○ | ○ | ○ | ○ | ○ | ● | | | | | | | | | 108 | 81 |
| 7 | ○ | ○ | ○ | ○ | ○ | ○ | ● | | | | | | | | 160 | 120 |
| 8 | ○ | ○ | ○ | ○ | ○ | ○ | ○ | ● | | | | | | | 224 | 168 |
| 9 | ○ | ○ | ○ | ○ | ○ | ○ | ○ | ○ | ● | | | | | | 300 | 225 |
| 10 | ○ | ○ | ○ | ○ | ○ | ○ | ○ | ○ | ○ | ● | | | | | 388 | 291 |
| 11 | ○ | ○ | ○ | ○ | ○ | ○ | ○ | ○ | ○ | ○ | ● | | | | 488 | 366 |
| 12 | ○ | ○ | ○ | ○ | ○ | ○ | ○ | ○ | ○ | ○ | ○ | ● | | | 600 | 450 |
| 13 | ○ | ○ | ○ | ○ | ○ | ○ | ○ | ○ | ○ | ○ | ○ | ○ | ● | | 728 | 546 |
| 14 | ○ | ○ | ○ | ○ | ○ | ○ | ○ | ○ | ○ | ○ | ○ | ○ | ○ | ● | 868 | 651 |
| 15 | ○ | ○ | ○ | ○ | ○ | ○ | ○ | ○ | ○ | ○ | ○ | ○ | ○ | ○ | 1024 | 768 |

BLACK CIRCLE : SELECTIVE ERASING DISCHARGE
WHITE CIRCLE : LIGHT EMISSION

FIG. 21

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERNS IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASING DISCHARGE
WHITE CIRCLE : LIGHT EMISSION

FIG.23

| LUMINANCE | DBL | LUMINANCE | HDP | LUMINANCE | DBL | LUMINANCE | HDP |
|---|---|---|---|---|---|---|---|
| | 0 ~ 7 | | 0 ~ 8 | | 0 ~ 7 | | 0 ~ 8 |
| 0 | 00000000 | 0 | 000000000 | 64 | 01000000 | 88 | 001011000 |
| 1 | 00000001 | 1 | 000000001 | 65 | 01000001 | 89 | 001011001 |
| 2 | 00000010 | 2 | 000000010 | 66 | 01000010 | 91 | 001011011 |
| 3 | 00000011 | 3 | 000000011 | 67 | 01000011 | 92 | 001011100 |
| 4 | 00000100 | 4 | 000000100 | 68 | 01000100 | 93 | 001011101 |
| 5 | 00000101 | 5 | 000000101 | 69 | 01000101 | 95 | 001011111 |
| 6 | 00000110 | 6 | 000000110 | 70 | 01000110 | 96 | 001100000 |
| 7 | 00000111 | 8 | 000001000 | 71 | 01000111 | 98 | 001100010 |
| 8 | 00001000 | 9 | 000001001 | 72 | 01001000 | 99 | 001100011 |
| 9 | 00001001 | 11 | 000001011 | 73 | 01001001 | 100 | 001100100 |
| 10 | 00001010 | 12 | 000001100 | 74 | 01001010 | 102 | 001100110 |
| 11 | 00001011 | 13 | 000001101 | 75 | 01001011 | 103 | 001100111 |
| 12 | 00001100 | 15 | 000001111 | 76 | 01001100 | 104 | 001101000 |
| 13 | 00001101 | 16 | 000010000 | 77 | 01001101 | 106 | 001101010 |
| 14 | 00001110 | 17 | 000010001 | 78 | 01001110 | 107 | 001101011 |
| 15 | 00001111 | 19 | 000010011 | 79 | 01001111 | 109 | 001101101 |
| 16 | 00010000 | 20 | 000010100 | 80 | 01010000 | 110 | 001101110 |
| 17 | 00010001 | 22 | 000010110 | 81 | 01010001 | 111 | 001101111 |
| 18 | 00010010 | 23 | 000010111 | 82 | 01010010 | 113 | 001110001 |
| 19 | 00010011 | 24 | 000011000 | 83 | 01010011 | 114 | 001110010 |
| 20 | 00010100 | 26 | 000011010 | 84 | 01010100 | 115 | 001110011 |
| 21 | 00010101 | 27 | 000011011 | 85 | 01010101 | 117 | 001110101 |
| 22 | 00010110 | 28 | 000011100 | 86 | 01010110 | 118 | 001110110 |
| 23 | 00010111 | 30 | 000011110 | 87 | 01010111 | 120 | 001111000 |
| 24 | 00011000 | 31 | 000011111 | 88 | 01011000 | 121 | 001111001 |
| 25 | 00011001 | 33 | 000100001 | 89 | 01011001 | 122 | 001111010 |
| 26 | 00011010 | 34 | 000100010 | 90 | 01011010 | 124 | 001111100 |
| 27 | 00011011 | 35 | 000100011 | 91 | 01011011 | 125 | 001111101 |
| 28 | 00011100 | 36 | 000100100 | 92 | 01011100 | 126 | 001111110 |
| 29 | 00011101 | 36 | 000100100 | 93 | 01011101 | 128 | 010000000 |
| 30 | 00011110 | 37 | 000100101 | 94 | 01011110 | 129 | 010000001 |
| 31 | 00011111 | 38 | 000100110 | 95 | 01011111 | 131 | 010000011 |
| 32 | 00100000 | 40 | 000101000 | 96 | 01100000 | 132 | 010000100 |
| 33 | 00100001 | 41 | 000101001 | 97 | 01100001 | 133 | 010000101 |
| 34 | 00100010 | 42 | 000101010 | 98 | 01100010 | 135 | 010000111 |
| 35 | 00100011 | 44 | 000101100 | 99 | 01100011 | 136 | 010001000 |
| 36 | 00100100 | 45 | 000101101 | 100 | 01100100 | 138 | 010001010 |
| 37 | 00100101 | 46 | 000101110 | 101 | 01100101 | 139 | 010001011 |
| 38 | 00100110 | 48 | 000110000 | 102 | 01100110 | 140 | 010001100 |
| 39 | 00100111 | 49 | 000110001 | 103 | 01100111 | 142 | 010001110 |
| 40 | 00101000 | 50 | 000110010 | 104 | 01101000 | 143 | 010001111 |
| 41 | 00101001 | 51 | 000110011 | 105 | 01101001 | 144 | 010010000 |
| 42 | 00101010 | 52 | 000110100 | 106 | 01101010 | 146 | 010010010 |
| 43 | 00101011 | 53 | 000110101 | 107 | 01101011 | 147 | 010010011 |
| 44 | 00101100 | 55 | 000110111 | 108 | 01101100 | 149 | 010010101 |
| 45 | 00101101 | 56 | 000111000 | 109 | 01101101 | 150 | 010010110 |
| 46 | 00101110 | 57 | 000111001 | 110 | 01101110 | 151 | 010010111 |
| 47 | 00101111 | 59 | 000111011 | 111 | 01101111 | 153 | 010011001 |
| 48 | 00110000 | 60 | 000111100 | 112 | 01110000 | 154 | 010011010 |
| 49 | 00110001 | 62 | 000111110 | 113 | 01110001 | 155 | 010011011 |
| 50 | 00110010 | 63 | 000111111 | 114 | 01110010 | 157 | 010011101 |
| 51 | 00110011 | 64 | 001000000 | 115 | 01110011 | 158 | 010011110 |
| 52 | 00110100 | 66 | 001000010 | 116 | 01110100 | 160 | 010100000 |
| 53 | 00110101 | 67 | 001000011 | 117 | 01110101 | 161 | 010100001 |
| 54 | 00110110 | 69 | 001000101 | 118 | 01110110 | 162 | 010100010 |
| 55 | 00110111 | 70 | 001000110 | 119 | 01110111 | 164 | 010100100 |
| 56 | 00111000 | 71 | 001000111 | 120 | 01111000 | 165 | 010100101 |
| 57 | 00111001 | 73 | 001001001 | 121 | 01111001 | 167 | 010100111 |
| 58 | 00111010 | 74 | 001001010 | 122 | 01111010 | 168 | 010101000 |
| 59 | 00111011 | 75 | 001001011 | 123 | 01111011 | 169 | 010101001 |
| 60 | 00111100 | 77 | 001001101 | 124 | 01111100 | 171 | 010101011 |
| 61 | 00111101 | 78 | 001001110 | 125 | 01111101 | 172 | 010101100 |
| 62 | 00111110 | 80 | 001010000 | 126 | 01111110 | 173 | 010101101 |
| 63 | 00111111 | 81 | 001010001 | 127 | 01111111 | 175 | 010101111 |

FIG. 24

| LUMINANCE | DBL | LUMINANCE | HDP | LUMINANCE | DBL | LUMINANCE | HDP |
|---|---|---|---|---|---|---|---|
| | 0 ~ 7 | | 0 ~ 8 | | 0 ~ 7 | | 0 ~ 8 |
| 128 | 10000000 | 176 | 010110000 | 192 | 11000000 | 265 | 100001001 |
| 129 | 10000001 | 178 | 010110010 | 193 | 11000001 | 266 | 100001010 |
| 130 | 10000010 | 179 | 010110011 | 194 | 11000010 | 267 | 100001011 |
| 131 | 10000011 | 180 | 010110100 | 195 | 11000011 | 269 | 100001101 |
| 132 | 10000100 | 182 | 010110110 | 196 | 11000100 | 270 | 100001110 |
| 133 | 10000101 | 183 | 010110111 | 197 | 11000101 | 271 | 100001111 |
| 134 | 10000110 | 184 | 010111000 | 198 | 11000110 | 273 | 100010001 |
| 135 | 10000111 | 186 | 010111010 | 199 | 11000111 | 274 | 100010010 |
| 136 | 10001000 | 187 | 010111011 | 200 | 11001000 | 276 | 100010100 |
| 137 | 10001001 | 189 | 010111101 | 201 | 11001001 | 277 | 100010101 |
| 138 | 10001010 | 190 | 010111110 | 202 | 11001010 | 278 | 100010110 |
| 139 | 10001011 | 191 | 010111111 | 203 | 11001011 | 280 | 100011000 |
| 140 | 10001100 | 193 | 011000001 | 204 | 11001100 | 281 | 100011001 |
| 141 | 10001101 | 194 | 011000010 | 205 | 11001101 | 282 | 100011010 |
| 142 | 10001110 | 196 | 011000100 | 206 | 11001110 | 284 | 100011100 |
| 143 | 10001111 | 197 | 011000101 | 207 | 11001111 | 285 | 100011101 |
| 144 | 10010000 | 198 | 011000110 | 208 | 11010000 | 287 | 100011111 |
| 145 | 10010001 | 200 | 011001000 | 209 | 11010001 | 288 | 100100000 |
| 146 | 10010010 | 201 | 011001001 | 210 | 11010010 | 289 | 100100001 |
| 147 | 10010011 | 202 | 011001010 | 211 | 11010011 | 291 | 100100011 |
| 148 | 10010100 | 204 | 011001100 | 212 | 11010100 | 292 | 100100100 |
| 149 | 10010101 | 205 | 011001101 | 213 | 11010101 | 294 | 100100110 |
| 150 | 10010110 | 207 | 011001111 | 214 | 11010110 | 295 | 100100111 |
| 151 | 10010111 | 208 | 011010000 | 215 | 11010111 | 296 | 100101000 |
| 152 | 10011000 | 209 | 011010001 | 216 | 11011000 | 298 | 100101010 |
| 153 | 10011001 | 211 | 011010011 | 217 | 11011001 | 299 | 100101011 |
| 154 | 10011010 | 212 | 011010100 | 218 | 11011010 | 300 | 100101100 |
| 155 | 10011011 | 213 | 011010101 | 219 | 11011011 | 302 | 100101110 |
| 156 | 10011100 | 215 | 011010111 | 220 | 11011100 | 303 | 100101111 |
| 157 | 10011101 | 216 | 011011000 | 221 | 11011101 | 305 | 100110001 |
| 158 | 10011110 | 218 | 011011010 | 222 | 11011110 | 306 | 100110010 |
| 159 | 10011111 | 219 | 011011011 | 223 | 11011111 | 307 | 100110011 |
| 160 | 10100000 | 220 | 011011100 | 224 | 11100000 | 309 | 100110101 |
| 161 | 10100001 | 222 | 011011110 | 225 | 11100001 | 310 | 100110110 |
| 162 | 10100010 | 223 | 011011111 | 226 | 11100010 | 311 | 100110111 |
| 163 | 10100011 | 225 | 011100001 | 227 | 11100011 | 313 | 100111001 |
| 164 | 10100100 | 226 | 011100010 | 228 | 11100100 | 314 | 100111010 |
| 165 | 10100101 | 227 | 011100011 | 229 | 11100101 | 316 | 100111100 |
| 166 | 10100110 | 229 | 011100101 | 230 | 11100110 | 317 | 100111101 |
| 167 | 10100111 | 230 | 011100110 | 231 | 11100111 | 318 | 100111110 |
| 168 | 10101000 | 231 | 011100111 | 232 | 11101000 | 320 | 101000000 |
| 169 | 10101001 | 233 | 011101001 | 233 | 11101001 | 321 | 101000001 |
| 170 | 10101010 | 234 | 011101010 | 234 | 11101010 | 323 | 101000011 |
| 171 | 10101011 | 236 | 011101100 | 235 | 11101011 | 324 | 101000100 |
| 172 | 10101100 | 237 | 011101101 | 236 | 11101100 | 325 | 101000101 |
| 173 | 10101101 | 238 | 011101110 | 237 | 11101101 | 327 | 101000111 |
| 174 | 10101110 | 240 | 011110000 | 238 | 11101110 | 328 | 101001000 |
| 175 | 10101111 | 241 | 011110001 | 239 | 11101111 | 329 | 101001001 |
| 176 | 10110000 | 242 | 011110010 | 240 | 11110000 | 331 | 101001011 |
| 177 | 10110001 | 244 | 011110100 | 241 | 11110001 | 332 | 101001100 |
| 178 | 10110010 | 245 | 011110101 | 242 | 11110010 | 334 | 101001110 |
| 179 | 10110011 | 247 | 011110111 | 243 | 11110011 | 335 | 101001111 |
| 180 | 10110100 | 248 | 011111000 | 244 | 11110100 | 336 | 101010000 |
| 181 | 10110101 | 249 | 011111001 | 245 | 11110101 | 338 | 101010010 |
| 182 | 10110110 | 251 | 011111011 | 246 | 11110110 | 339 | 101010011 |
| 183 | 10110111 | 252 | 011111100 | 247 | 11110111 | 340 | 101010100 |
| 184 | 10111000 | 253 | 011111101 | 248 | 11111000 | 342 | 101010110 |
| 185 | 10111001 | 255 | 011111111 | 249 | 11111001 | 343 | 101010111 |
| 186 | 10111010 | 256 | 100000000 | 250 | 11111010 | 345 | 101011001 |
| 187 | 10111011 | 258 | 100000010 | 251 | 11111011 | 346 | 101011010 |
| 188 | 10111100 | 259 | 100000011 | 252 | 11111100 | 347 | 101011011 |
| 189 | 10111101 | 260 | 100000100 | 253 | 11111101 | 349 | 101011101 |
| 190 | 10111110 | 262 | 100000110 | 254 | 11111110 | 350 | 101011110 |
| 191 | 10111111 | 263 | 100000111 | 255 | 11111111 | 352 | 101100000 |

FIG. 25

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERNS IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 00000 | 1 | 0 | 0 | 0 | 0 | 0 | 1 | 0 | 0 | 0 | 0 | 0 | 0 | 0 | ● | | | | | | ● | | | | | | | | 0 |
| 00001 | 0 | 1 | 0 | 0 | 0 | 0 | 1 | 0 | 0 | 0 | 0 | 0 | 0 | 0 | ○ | ● | | | | | ● | | | | | | | | 1 |
| 00010 | 0 | 0 | 1 | 0 | 0 | 0 | 1 | 0 | 0 | 0 | 0 | 0 | 0 | 0 | ○ | ○ | ● | | | | ● | | | | | | | | 2 |
| 00011 | 0 | 0 | 0 | 1 | 0 | 0 | 1 | 0 | 0 | 0 | 0 | 0 | 0 | 0 | ○ | ○ | ○ | ● | | | ● | | | | | | | | 3 |
| 00100 | 0 | 0 | 0 | 0 | 1 | 0 | 1 | 0 | 0 | 0 | 0 | 0 | 0 | 0 | ○ | ○ | ○ | ○ | ● | | ● | | | | | | | | 6 |
| 00101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | 9 |
| 00110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 17 |
| 00111 | 0 | 0 | 0 | 0 | 0 | 1 | 0 | 1 | 0 | 0 | 0 | 0 | 0 | 0 | ○ | ○ | ○ | ○ | ○ | ● | ○ | ● | | | | | | | 22 |
| 01000 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 30 |
| 01001 | 0 | 0 | 0 | 0 | 0 | 1 | 0 | 0 | 1 | 0 | 0 | 0 | 0 | 0 | ○ | ○ | ○ | ○ | ○ | ● | ○ | ○ | ● | | | | | | 37 |
| 01010 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 45 |
| 01011 | 0 | 0 | 0 | 0 | 0 | 1 | 0 | 0 | 0 | 1 | 0 | 0 | 0 | 0 | ○ | ○ | ○ | ○ | ○ | ● | ○ | ○ | ○ | ● | | | | | 57 |
| 01100 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 65 |
| 01101 | 0 | 0 | 0 | 0 | 0 | 1 | 0 | 0 | 0 | 0 | 1 | 0 | 0 | 0 | ○ | ○ | ○ | ○ | ○ | ● | ○ | ○ | ○ | ○ | ● | | | | 82 |
| 01110 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 90 |
| 01111 | 0 | 0 | 0 | 0 | 0 | 1 | 0 | 0 | 0 | 0 | 0 | 1 | 0 | 0 | ○ | ○ | ○ | ○ | ○ | ● | ○ | ○ | ○ | ○ | ○ | ● | | | 113 |
| 10000 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 121 |
| 10001 | 0 | 0 | 0 | 0 | 0 | 1 | 0 | 0 | 0 | 0 | 0 | 0 | 1 | 0 | ○ | ○ | ○ | ○ | ○ | ● | ○ | ○ | ○ | ○ | ○ | ○ | ● | | 150 |
| 10010 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 158 |
| 10011 | 0 | 0 | 0 | 0 | 1 | 0 | 0 | 0 | 0 | 0 | 0 | 0 | 0 | 1 | ○ | ○ | ○ | ○ | ● | | ○ | ○ | ○ | ○ | ○ | ○ | ○ | ● | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 206 |
| 10101 | 0 | 0 | 0 | 0 | 1 | 0 | 0 | 0 | 0 | 0 | 0 | 0 | 0 | 0 | ○ | ○ | ○ | ○ | ● | | ○ | ○ | ○ | ○ | ○ | ○ | ○ | ○ | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASING DISCHARGE
WHITE CIRCLE : LIGHT EMISSION

FIG. 26

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERNS IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 1 | 0 | 0 | 0 | 0 | 0 | 0 | 0 | 0 | 0 | 0 | 0 | 0 | ● | ● | | | | | | | | | | | | | 0 |
| 0001 | 0 | 1 | 1 | 0 | 0 | 0 | 0 | 0 | 0 | 0 | 0 | 0 | 0 | 0 | ○ | ● | ● | | | | | | | | | | | | 1 |
| 0010 | 0 | 0 | 1 | 1 | 0 | 0 | 0 | 0 | 0 | 0 | 0 | 0 | 0 | 0 | ○ | ○ | ● | ● | | | | | | | | | | | 4 |
| 0011 | 0 | 0 | 0 | 1 | 1 | 0 | 0 | 0 | 0 | 0 | 0 | 0 | 0 | 0 | ○ | ○ | ○ | ● | ● | | | | | | | | | | 9 |
| 0100 | 0 | 0 | 0 | 0 | 1 | 1 | 0 | 0 | 0 | 0 | 0 | 0 | 0 | 0 | ○ | ○ | ○ | ○ | ● | ● | | | | | | | | | 17 |
| 0101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | 27 |
| 0110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | 40 |
| 0111 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | 56 |
| 1000 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | 75 |
| 1001 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | 97 |
| 1010 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | 122 |
| 1011 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASING DISCHARGE
WHITE CIRCLE : LIGHT EMISSION

FIG. 27

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERNS IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 0 | 1 | 0 | 0 | 0 | 0 | 0 | 0 | 0 | 0 | 0 | 0 | 0 | ● | | ● | | | | | | | | | | | | 0 |
| 0001 | 0 | 1 | 0 | 1 | 0 | 0 | 0 | 0 | 0 | 0 | 0 | 0 | 0 | 0 | ○ | ● | | ● | | | | | | | | | | | 1 |
| 0010 | 0 | 0 | 1 | 0 | 1 | 0 | 0 | 0 | 0 | 0 | 0 | 0 | 0 | 0 | ○ | ○ | ● | | ● | | | | | | | | | | 4 |
| 0011 | 0 | 0 | 0 | 1 | 0 | 1 | 0 | 0 | 0 | 0 | 0 | 0 | 0 | 0 | ○ | ○ | ○ | ● | | ● | | | | | | | | | 9 |
| 0100 | 0 | 0 | 0 | 0 | 1 | 0 | 1 | 0 | 0 | 0 | 0 | 0 | 0 | 0 | ○ | ○ | ○ | ○ | ● | | ● | | | | | | | | 17 |
| 0101 | 0 | 0 | 0 | 0 | 0 | 1 | 0 | 1 | 0 | 0 | 0 | 0 | 0 | 0 | ○ | ○ | ○ | ○ | ○ | ● | | ● | | | | | | | 27 |
| 0110 | 0 | 0 | 0 | 0 | 0 | 0 | 1 | 0 | 1 | 0 | 0 | 0 | 0 | 0 | ○ | ○ | ○ | ○ | ○ | ○ | ● | | ● | | | | | | 40 |
| 0111 | 0 | 0 | 0 | 0 | 0 | 0 | 0 | 1 | 0 | 1 | 0 | 0 | 0 | 0 | ○ | ○ | ○ | ○ | ○ | ○ | ○ | ● | | ● | | | | | 56 |
| 1000 | 0 | 0 | 0 | 0 | 0 | 0 | 0 | 0 | 1 | 0 | 1 | 0 | 0 | 0 | ○ | ○ | ○ | ○ | ○ | ○ | ○ | ○ | ● | | ● | | | | 75 |
| 1001 | 0 | 0 | 0 | 0 | 0 | 0 | 0 | 0 | 0 | 1 | 0 | 1 | 0 | 0 | ○ | ○ | ○ | ○ | ○ | ○ | ○ | ○ | ○ | ● | | ● | | | 97 |
| 1010 | 0 | 0 | 0 | 0 | 0 | 0 | 0 | 0 | 0 | 0 | 1 | 0 | 1 | 0 | ○ | ○ | ○ | ○ | ○ | ○ | ○ | ○ | ○ | ○ | ● | | ● | | 122 |
| 1011 | 0 | 0 | 0 | 0 | 0 | 0 | 0 | 0 | 0 | 0 | 0 | 1 | 0 | 1 | ○ | ○ | ○ | ○ | ○ | ○ | ○ | ○ | ○ | ○ | ○ | ● | | ● | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASING DISCHARGE
WHITE CIRCLE : LIGHT EMISSION

FIG. 28

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERNS IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 0000 | 1 | 1 | * | * | * | * | * | * | * | * | * | * | * | * | ● | ● | △ | △ | △ | △ | △ | △ | △ | △ | △ | △ | △ | △ | 0 |
| 0001 | 0 | 1 | 1 | * | * | * | * | * | * | * | * | * | * | * | ○ | ● | ● | △ | △ | △ | △ | △ | △ | △ | △ | △ | △ | △ | 1 |
| 0010 | 0 | 0 | 1 | 1 | * | * | * | * | * | * | * | * | * | * | ○ | ○ | ● | ● | △ | △ | △ | △ | △ | △ | △ | △ | △ | △ | 4 |
| 0011 | 0 | 0 | 0 | 1 | 1 | * | * | * | * | * | * | * | * | * | ○ | ○ | ○ | ● | ● | △ | △ | △ | △ | △ | △ | △ | △ | △ | 9 |
| 0100 | 0 | 0 | 0 | 0 | 1 | 1 | * | * | * | * | * | * | * | * | ○ | ○ | ○ | ○ | ● | ● | △ | △ | △ | △ | △ | △ | △ | △ | 17 |
| 0101 | 0 | 0 | 0 | 0 | 0 | 1 | 1 | * | * | * | * | * | * | * | ○ | ○ | ○ | ○ | ○ | ● | ● | △ | △ | △ | △ | △ | △ | △ | 27 |
| 0110 | 0 | 0 | 0 | 0 | 0 | 0 | 1 | 1 | * | * | * | * | * | * | ○ | ○ | ○ | ○ | ○ | ○ | ● | ● | △ | △ | △ | △ | △ | △ | 40 |
| 0111 | 0 | 0 | 0 | 0 | 0 | 0 | 0 | 1 | 1 | * | * | * | * | * | ○ | ○ | ○ | ○ | ○ | ○ | ○ | ● | ● | △ | △ | △ | △ | △ | 56 |
| 1000 | 0 | 0 | 0 | 0 | 0 | 0 | 0 | 0 | 1 | 1 | * | * | * | * | ○ | ○ | ○ | ○ | ○ | ○ | ○ | ○ | ● | ● | △ | △ | △ | △ | 75 |
| 1001 | 0 | 0 | 0 | 0 | 0 | 0 | 0 | 0 | 0 | 1 | 1 | * | * | * | ○ | ○ | ○ | ○ | ○ | ○ | ○ | ○ | ○ | ● | ● | △ | △ | △ | 97 |
| 1010 | 0 | 0 | 0 | 0 | 0 | 0 | 0 | 0 | 0 | 0 | 1 | 1 | * | * | ○ | ○ | ○ | ○ | ○ | ○ | ○ | ○ | ○ | ○ | ● | ● | △ | △ | 122 |
| 1011 | 0 | 0 | 0 | 0 | 0 | 0 | 0 | 0 | 0 | 0 | 0 | 1 | 1 | * | ○ | ○ | ○ | ○ | ○ | ○ | ○ | ○ | ○ | ○ | ○ | ● | ● | △ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASING DISCHARGE
WHITE CIRCLE : LIGHT EMISSION

FIG. 29

[SELECTIVE WRITING]

| Ds | HD 1 | 2 | 3 | 4 | 5 | 6 | 7 | 8 | 9 | 10 | 11 | 12 | 13 | 14 | LIGHT EMISSION DRIVING PATTERNS IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE OF EMITTED LIGHT |
|---|---|---|---|---|---|---|---|---|---|---|---|---|---|---|---|---|---|---|---|---|---|---|---|---|---|---|---|---|---|
| 00000 | 1 | 1 | 0 | 0 | 0 | 0 | 1 | 1 | 0 | 0 | 0 | 0 | 0 | 0 | ● | ● | | | | | ● | ● | | | | | | | 0 |
| 00001 | 0 | 1 | 1 | 0 | 0 | 0 | 1 | 1 | 0 | 0 | 0 | 0 | 0 | 0 | ○ | ● | ● | | | | ● | ● | | | | | | | 1 |
| 00010 | 0 | 0 | 1 | 1 | 0 | 0 | 1 | 1 | 0 | 0 | 0 | 0 | 0 | 0 | ○ | ○ | ● | ● | | | ● | ● | | | | | | | 2 |
| 00011 | 0 | 0 | 0 | 1 | 1 | 0 | 1 | 1 | 0 | 0 | 0 | 0 | 0 | 0 | ○ | ○ | ○ | ● | ● | | ● | ● | | | | | | | 3 |
| 00100 | 0 | 0 | 0 | 0 | 1 | 1 | 1 | 1 | 0 | 0 | 0 | 0 | 0 | 0 | ○ | ○ | ○ | ○ | ● | ● | ● | ● | | | | | | | 6 |
| 00101 | 0 | 0 | 0 | 0 | 0 | 1 | 1 | 1 | 0 | 0 | 0 | 0 | 0 | 0 | ○ | ○ | ○ | ○ | ○ | ● | ● | ● | | | | | | | 9 |
| 00110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | 17 |
| 00111 | 0 | 0 | 0 | 0 | 0 | 1 | 0 | 1 | 1 | 0 | 0 | 0 | 0 | 0 | ○ | ○ | ○ | ○ | ○ | ● | ○ | ● | ● | | | | | | 22 |
| 01000 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | 30 |
| 01001 | 0 | 0 | 0 | 0 | 0 | 1 | 0 | 0 | 1 | 1 | 0 | 0 | 0 | 0 | ○ | ○ | ○ | ○ | ○ | ● | ○ | ○ | ● | ● | | | | | 37 |
| 01010 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | 45 |
| 01011 | 0 | 0 | 0 | 0 | 0 | 1 | 0 | 0 | 0 | 1 | 1 | 0 | 0 | 0 | ○ | ○ | ○ | ○ | ○ | ● | ○ | ○ | ○ | ● | ● | | | | 57 |
| 01100 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | 65 |
| 01101 | 0 | 0 | 0 | 0 | 0 | 1 | 0 | 0 | 0 | 0 | 1 | 1 | 0 | 0 | ○ | ○ | ○ | ○ | ○ | ● | ○ | ○ | ○ | ○ | ● | ● | | | 82 |
| 01110 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | 90 |
| 01111 | 0 | 0 | 0 | 0 | 0 | 1 | 0 | 0 | 0 | 0 | 0 | 1 | 1 | 0 | ○ | ○ | ○ | ○ | ○ | ● | ○ | ○ | ○ | ○ | ○ | ● | ● | | 113 |
| 10000 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | 121 |
| 10001 | 0 | 0 | 0 | 0 | 0 | 1 | 0 | 0 | 0 | 0 | 0 | 0 | 1 | 1 | ○ | ○ | ○ | ○ | ○ | ● | ○ | ○ | ○ | ○ | ○ | ○ | ● | ● | 150 |
| 10010 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 158 |
| 10011 | 0 | 0 | 0 | 0 | 1 | 1 | 0 | 0 | 0 | 0 | 0 | 0 | 0 | 1 | ○ | ○ | ○ | ○ | ● | ● | ○ | ○ | ○ | ○ | ○ | ○ | ○ | ● | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 206 |
| 10101 | 0 | 0 | 0 | 0 | 1 | 1 | 0 | 0 | 0 | 0 | 0 | 0 | 0 | 0 | ○ | ○ | ○ | ○ | ● | ● | ○ | ○ | ○ | ○ | ○ | ○ | ○ | ○ | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASING DISCHARGE
WHITE CIRCLE : LIGHT EMISSION

METHOD OF DRIVING PLASMA DISPLAY PANEL

BACKGROUND OF THE INVENTION

1. Field of the Invention

The present invention relates to a method of driving a plasma display panel (hereinafter referred to as the "PDP") in accordance with a matrix display scheme.

2. Description of the Related Background Art

As one type of PDP driven in accordance with the matrix display scheme as mentioned, an AC (alternate current discharge) type PDP is known.

The AC type PDP comprises a plurality of column electrodes (address electrodes) and a plurality of pairs of row electrodes which are arranged orthogonal to the column electrodes and form respective scanning lines in pair. The respective row electrode pairs and column electrodes are covered with a dielectric material defining a discharge space, and are constructed to form a discharge cell corresponding to one pixel at the intersection of each row electrode pair and each column electrode.

In this event, since the PDP utilizes a discharge phenomenon, the discharge cells only have two states, i.e., "light emission" and "non-light emission." Thus, a subfield method is typically employed to realize gradation luminance representations in the PDP. The subfield method divides one field period into N subfields, each of which is allocated a light emission period (the number of times of light emission) corresponding to a weighting for each bit digit of pixel data (composed of N bits) to drive the PDP to emit light.

When one field period is divided, for example, into six subfields SF1–SF6 as shown in FIG. 1, the light emission driving is conducted with the following light emission period ratio allocated to the respective subfields:

SF1: 1

SF2: 2

SF3: 4

SF4: 8

SF5: 16

SF6: 32

For example, the light emission is conducted only in SF6 within the subfields SF1–SF6 when a discharge cell is driven to emit light at luminance "32," while the light emission is conducted in the remaining subfields SF1–SF5 except for the subfield SF6 when a discharge cell is driven to emit light at luminance "31." This enables luminance representations with gradation of 64 levels. In this event, a light emission driving pattern within one field period for driving the discharge cell to emit light at luminance "32" is reverse to that for driving the discharge cell to emit light at luminance "31." In other words, during one field period, a discharge cell which should be driven to emit light at luminance "31" is in non-light emitting state in a period in which a discharge cell which should be driven to emit light at luminance "32" is emitting light, and the discharge cell which should be driven to emit light at luminance "32" is in non-light emitting state in a period in which a discharge cell which should be driven to emit light at luminance "31" is emitting light.

Therefore, if there is a region in which a discharge cell which should be driven to emit light at luminance "32" and a discharge cell which should be driven to emit light at luminance "31" are located adjacent to each other, a spurious border can be viewed within this region. More specifically, when the line of sight is moved to a discharge cell which should be driven to emit light at luminance "32" immediately before a discharge cell which should be driven to emit light at luminance "31" transitions from a non-light emitting state to a light emitting state, the non-light emitting state of both the discharge cells are viewed in succession, causing a dark line to be viewed on the boundary of both the discharge cells. This dark line eventually appears on the screen as a spurious border which is not at all related to any pixel data, thus resulting in a degraded display quality.

In addition, since the PDP utilizes the discharge phenomenon as mentioned above, the PDP must conduct discharges (involving light emission) not related to the contents of a display, giving rise to a problem that the contrast is degraded in images.

Further, a general challenge in commercializing such PDP at present is to realize lower power consumption.

SUMMARY OF THE INVENTION

It is therefore an object of the present invention to provide a method of driving a plasma display panel which is capable of improving the contrast at low power consumption while suppressing spurious borders, and capable of stabilizing selective discharge to improve the display quality.

The method of driving a plasma display panel is adapted to display gradation representations in a plasma display panel having row electrode pairs arranged for respective scanning lines, a plurality of column electrodes arranged intersecting with the row electrode pairs, and discharge cells, each corresponding to one pixel, formed at respective intersections of the row electrode pairs for the respective scanning lines and the plurality of column electrodes. The method comprises the steps of dividing one field display period into N subfields, where N is an integer number equal to or larger than two, and forming M consecutively positioned subfields within the N subfields into a subfield group, where $2 \leqq M \leqq N$ is satisfied; executing, only in the first subfield of the subfield group, a reset stage for producing a discharge for initializing all the discharge cells into a light emitting cell state; executing, in any subfield within the subfield group, a pixel data writing stage for applying the column electrodes with pixel data pulses to produce a discharge for setting the discharge cells to non-light emitting cells, and for sequentially applying one electrode in each of the row electrode pairs with a scanning pulse in synchronism with the pixel data pulses; executing, in each subfield within the subfield group, a light emission sustaining stage for producing a discharge to drive only the light emitting cells to emit light a number of times corresponding to a weighting for the subfield; selecting one from a first mode in which the number of times of light emission in the light emission sustaining stage in each subfield of the subfield group is set to a first value, and a second mode in which the number of times of light emission in the light emission sustaining stage in each subfield of the subfield group is set to a second value smaller than the first value; and setting at least one of the values of a pulse width and a pulse voltage of the scanning pulse in each subfield within the subfield group when the second mode is selected larger than the value of the pulse width or the pulse voltage of the scanning pulse in each subfield within the subfield group when the first mode is selected.

BRIEF DESCRIPTION OF THE DRAWINGS

FIG. 7 is a table showing a correspondence relationship between luminance modes and the ratio of the numbers of light emission conducted in light emission sustaining stages of respective subfields;

FIGS. 9 and 10 show in combination an exemplary conversion table in the first data converting circuit 32;

FIG. 13 is a table showing exemplary patterns of light emission driving which is conducted based on the light emission driving format shown in FIG. 3;

FIG. 21 is a table showing all possible patterns of light emission driving conducted based on the light emission driving format shown in FIG. 3, and an exemplary conversion table used in a second data converting circuit 34 when this light emission driving is conducted;

FIGS. 23 and 24 show in combination an exemplary conversion table used in the first data converting circuit 32 when light emission is driven based on the light emission driving format shown in FIG. 22;

FIG. 25 is a table showing all possible patterns of light emission driving conducted based on the light emission driving format shown in FIG. 22, and an exemplary conversion table used in the second data converting circuit 34 when this light emission driving is conducted;

FIG. 26 shows a light emission driving pattern according to the driving method of the present invention;

FIG. 27 shows another exemplary light emission driving pattern according to the driving method of the present invention;

FIG. 28 shows a further exemplary light emission driving pattern according to the driving method of the present invention; and FIG. 29 shows a further exemplary light emission driving pattern according to the driving method of the present invention.

DESCRIPTION OF THE PREFERRED EMBODIMENTS

The present invention will hereinafter be described in conjunction with several embodiments thereof in detail with reference to the accompanying drawings.

Figure 1:
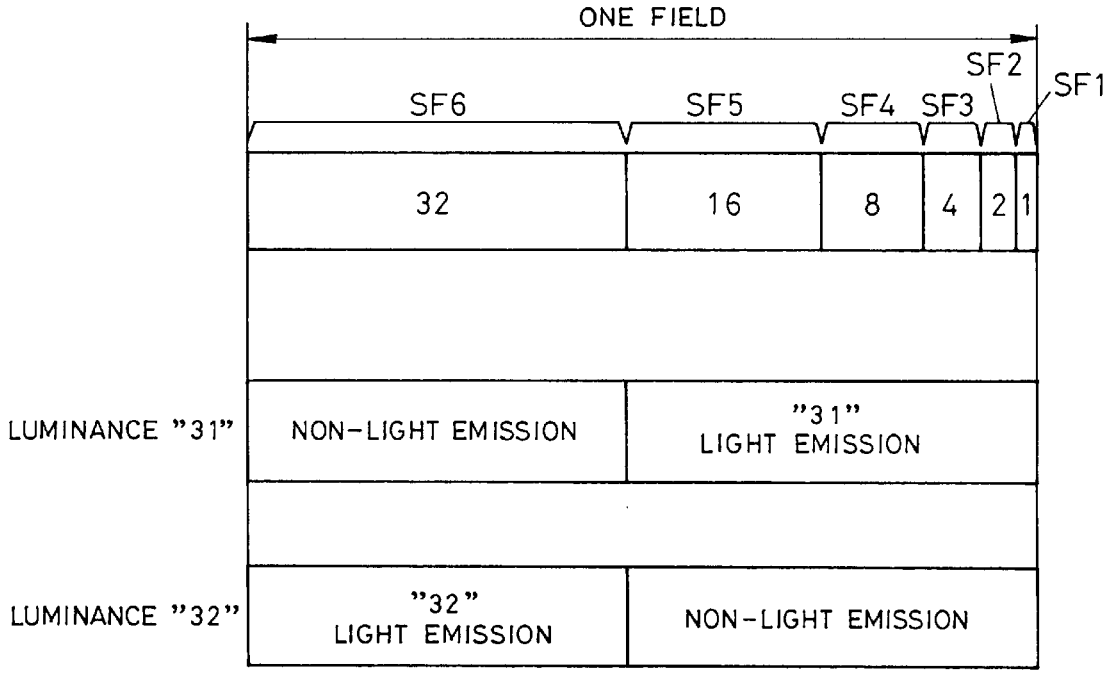
FIG. 1 shows a conventional light emission driving format for implementing 64-level gradation representations.
Figure 2:
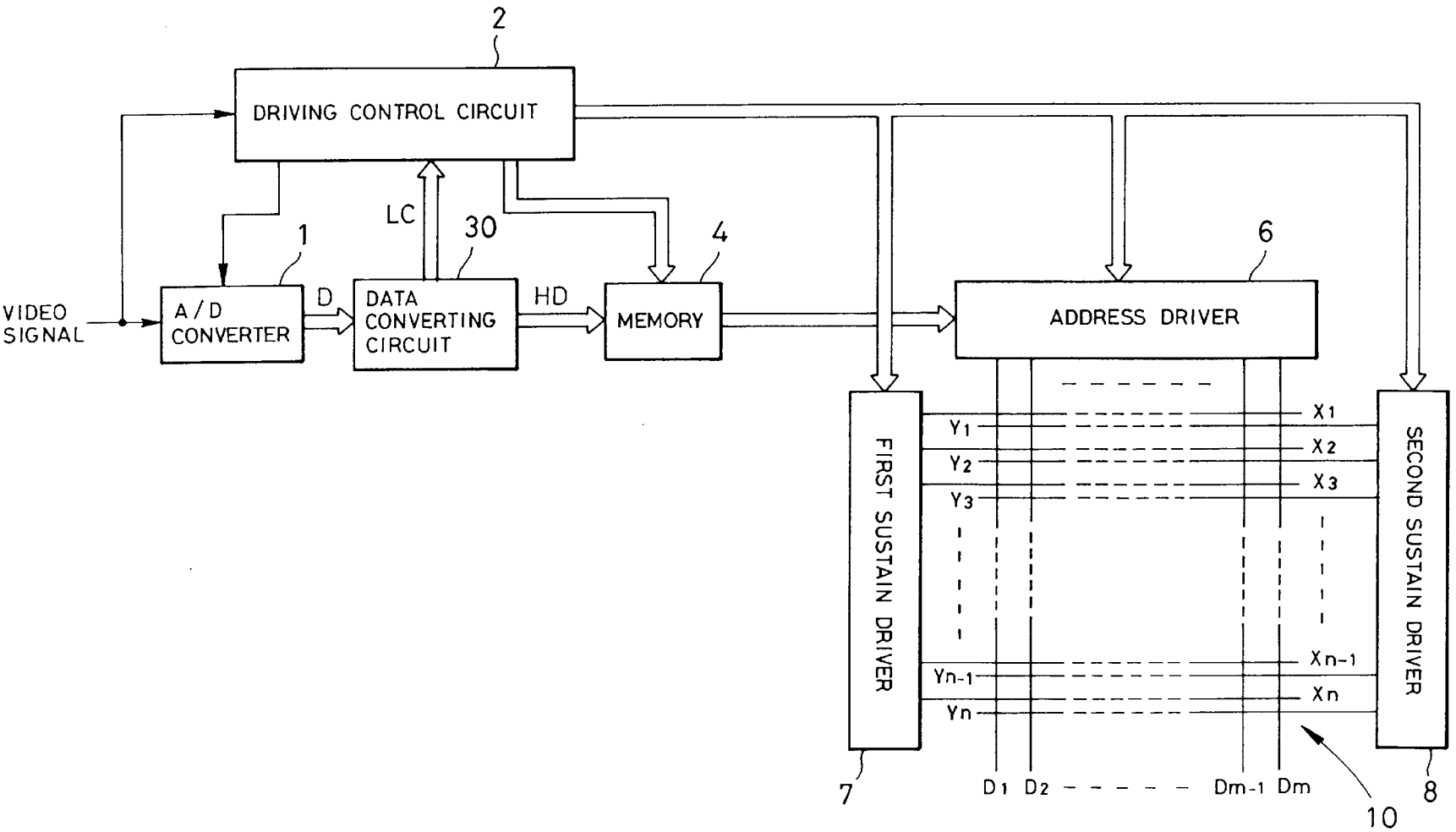
FIG. 2 is a block diagram generally illustrating the configuration of a plasma display device for driving a plasma display panel in accordance with a driving method of the present invention.

FIG. 2 generally illustrates the configuration of a plasma display device for driving a plasma display panel (hereinafter referred to as the "PDP") to emit light based on a driving method according to the present invention.

Referring specifically to FIG. 2, an A/D converter 1 samples an analog input video signal in response to a clock signal supplied thereto from a driving control circuit 2 to convert the same to, for example, 8-bit pixel data (input pixel data) D for each pixel, which is then supplied to a data converting circuit 30.

The driving control circuit 2 generates the clock signal for the A/D converter 1, and write and read signals for a memory 4 in synchronism with horizontal and vertical synchronization signals within the input video signal. The driving control circuit 2 also generates a variety of timing signals for driving or controlling each of an address driver 6, a first sustain driver 7 and a second sustain driver 8 in synchronism with the horizontal and vertical synchronization signals.

The data converting circuit 30 converts the 8-bit pixel data D to 14-bit converted pixel data (display pixel data) HD which is then supplied to the memory 4. The conversion operation performed by the data converting circuit 30 will be described later.

The converted pixel data HD are sequentially written into the memory 4 in accordance with a write signal supplied thereto from the driving control circuit 2. Once the converted pixel data HD have been written into the memory 4 for one screen portion (n rows and m columns) through the writing operation, each of the converted pixel data $HD_{11\text{-}nm}$ of the one screen portion is divided into respective bit digits which are read on a row-by-row basis from the memory 4 and sequentially supplied to an address driver 6.

The address driver 6 generates m pixel data pulses, each having a voltage corresponding to a logical level of a corresponding one in a group of pixel data bits for each row read from the memory 4, in response to a timing signal supplied from the driving control circuit 2, and applies these pixel data pulses to column electrodes $D_{1\text{-}Dm}$ of the PDP 10, respectively.

The PDP 10 comprises the column electrodes $D_1$–$D_m$ as address electrodes, and row electrodes $X_1$–$X_n$ and row electrodes $Y_1$–$Y_n$ which are arranged orthogonal to these column electrodes. In the PDP 10, a row electrode for one row of the screen is formed of a pair of a row electrode X and a row electrode Y. Specifically, a row electrode pair for the first row in the PDP 10 is formed of row electrodes $X_1$, $Y_1$, and a row electrode pair for the nth row is formed of row electrodes $X_n$, $Y_n$. The row electrode pairs and the column electrodes are covered with a dielectric layer defining a discharge space, and a discharge cell corresponding to one pixel is formed at an intersection of each row electrode pair with each column electrode.

The first sustain driver 7 and the second sustain driver 8 each generate a variety of driving pulses, as described below, in response to timing signals supplied from the driving control circuit t2, and apply these driving pulses to the row electrodes $X_1$–$X_n$ and $Y_1$–$Y_n$ of the PDP 10.

Figure 3:
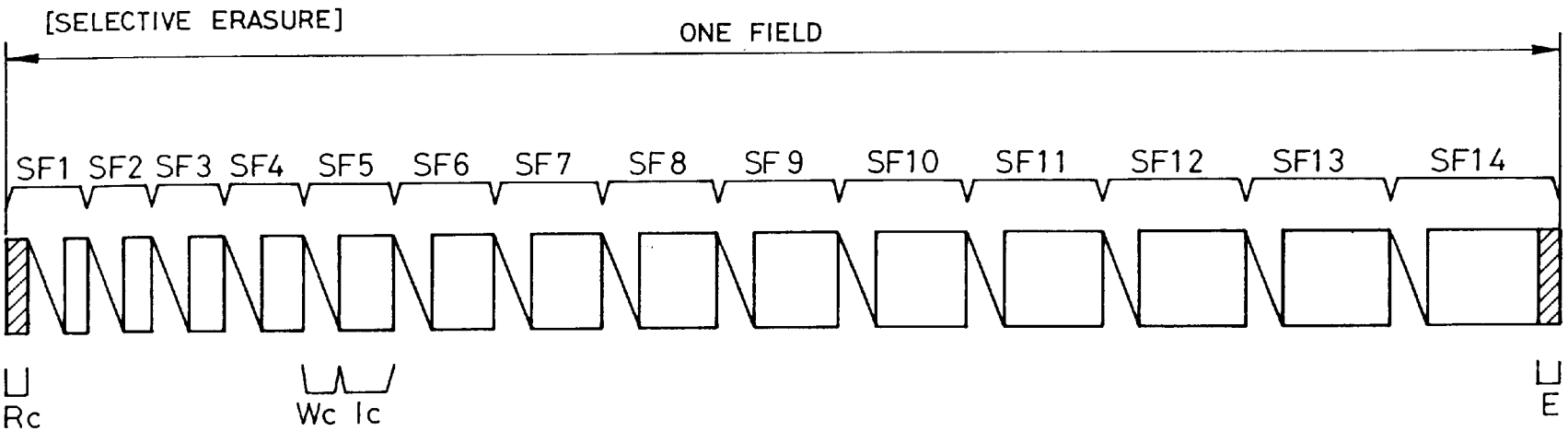
FIG. 3 shows a light emission driving format when a selective erasure address method is employed.

The plasma display device as described above drives the PDP 10 in response to the timing signal supplied from the driving control circuit 2 with a one-field display period divided into 14 subfields SF1–SF14 as shown in FIG. 3.

Figure 4:
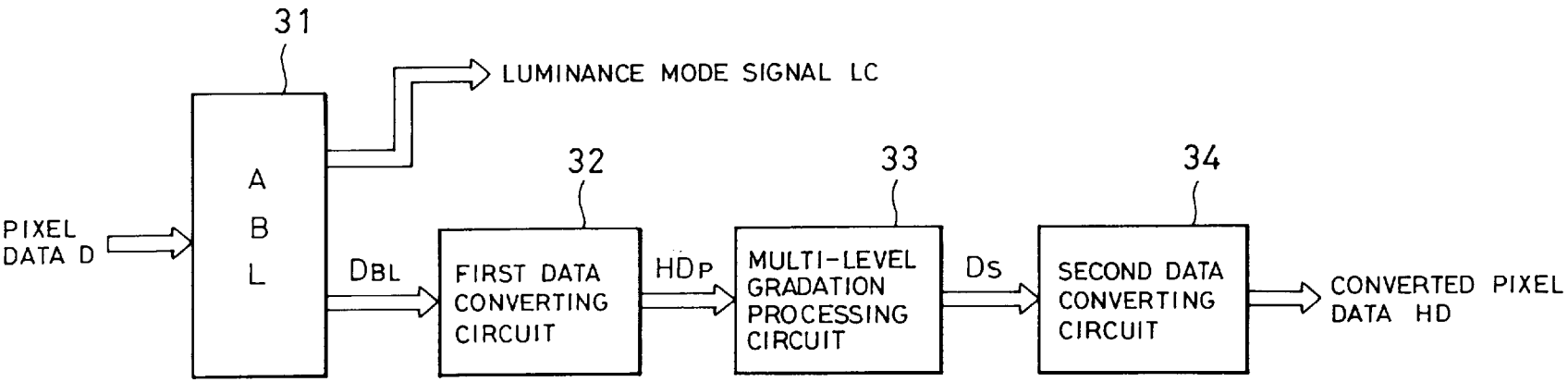
FIG. 4 is a block diagram illustrating the internal configuration of a data converting circuit 30.

FIG. 4 illustrates the internal configuration of the data converting circuit 30 as mentioned above. Referring specifically to FIG. 4, an ABL (automatic brightness limiting) circuit 31 adjusts the luminance level of pixel data D for each pixel sequentially supplied thereto from the A/D converter 1 such that an average luminance of pixels displayed on the screen of the PDP 10 falls within a predetermined luminance range, and supplies the resulting luminance adjusted pixel data $D_{BL}$ to a first data converting circuit 32.

The adjustment to the luminance level is performed before the light emission frequency ratio in the respective subfields is set nonlinear to make an inverse gamma correction. Thus, the ABL circuit 31 is adapted to conduct the inverse gamma correction on the pixel data D (input pixel data), and automatically adjust the luminance level of the pixel data D (input pixel data) in accordance with an average luminance of the thus produced inverse gamma converted pixel data. This can prevent the display quality from degradation due to the luminance adjustment.

Figure 5:
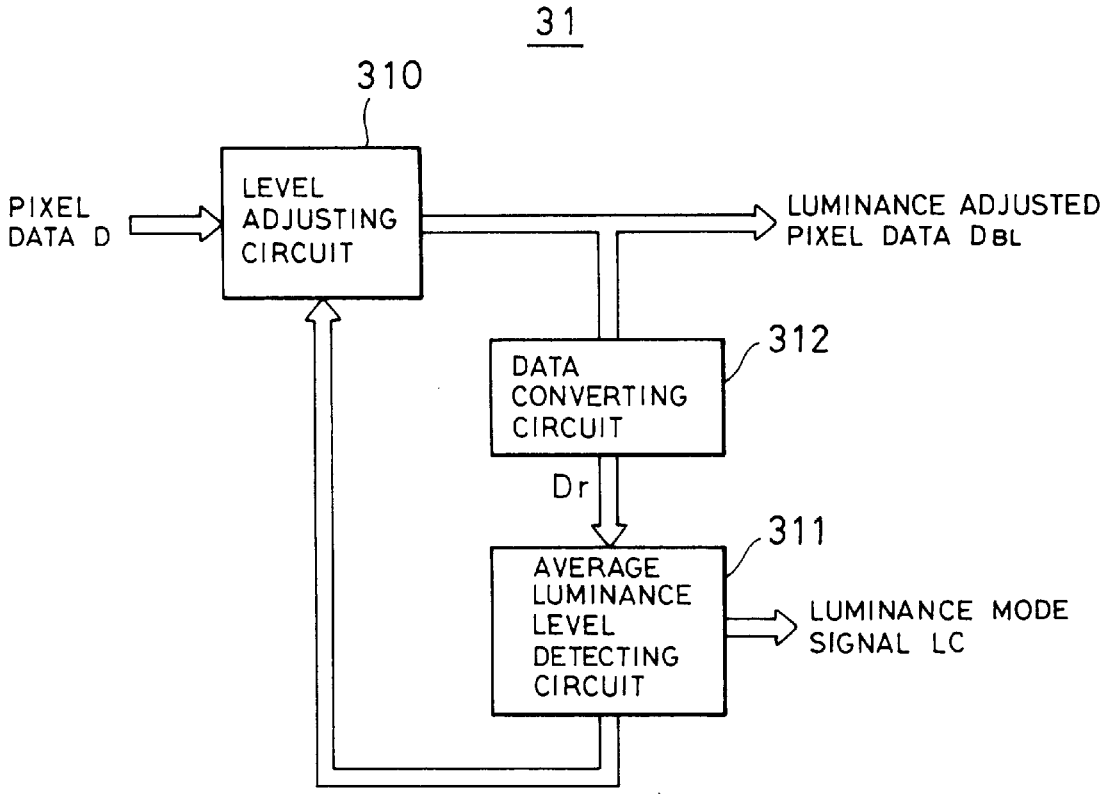
FIG. 5 is a block diagram illustrating the internal configuration of an ABL circuit 31.
Figure 6:
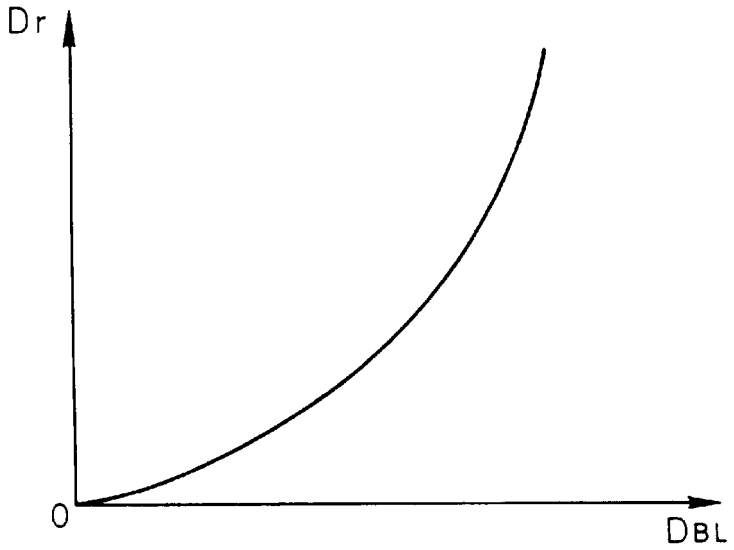
FIG. 6 is a graph illustrating a conversion characteristic in a data converting circuit 312.

FIG. 5 illustrates the internal configuration of the ABL circuit 31. Referring specifically to FIG. 5, a level adjusting circuit 310 adjusts the level of pixel data D in accordance with an average luminance calculated in an average luminance detecting circuit 311, later described, and outputs resulting luminance adjusted pixel data $D_{BL}$. A data converting circuit 312 converts the luminance adjusted pixel data $D_{BL}$ using the inverse gamma characteristic ($Y=X^{2.2}$) representing a nonlinear characteristic as illustrated in FIG. 6 to produce inverse gamma converted pixel data Dr which is supplied to the average luminance level detecting circuit 311. In other words, the data converting circuit 312 conducts the inverse gamma correction on the luminance adjusted pixel data $D_{BL}$ to recover pixel data (inverse gamma converted pixel data Dr) corresponding to an original video signal from which the gamma correction has been released.

For specifying a light emission period (the number of times of light emission) in each subfield, the average luminance detecting circuit 311 selects a luminance mode from a first mode and a second mode, for example as shown in FIG. 7, for driving the PDP 10 to emit light at a luminance corresponding to the average luminance which has been found as described above, and supplies the driving control circuit 2 with a luminance mode signal LC indicative of the selected luminance mode. In this event, the driving control circuit 2 sets a period in which light emission is sustained in a light emission sustaining stage Ic of each of the subfields SF1–SF14 shown in FIG. 3, i.e., the number of applied sustain pulses in each light emission sustaining stage Ic, in accordance with the light emission frequency ratio for a particular mode specified by a luminance mode signal LC as shown in FIG. 7. Specifically, the first mode is set when the average luminance level of the input pixel data D is below a predetermined value. The first mode is switched to the second mode, which provides a less number of times of light emission than the first mode for each subfield, when the average luminance level increases to the predetermined value or more, thereby automatically limiting the luminance.

The average luminance detecting circuit 311 also calculates an average luminance from the aforementioned inverse gamma converted pixel data Dr, and supplies the average luminance to the level adjusting circuit 310.

Figure 8:
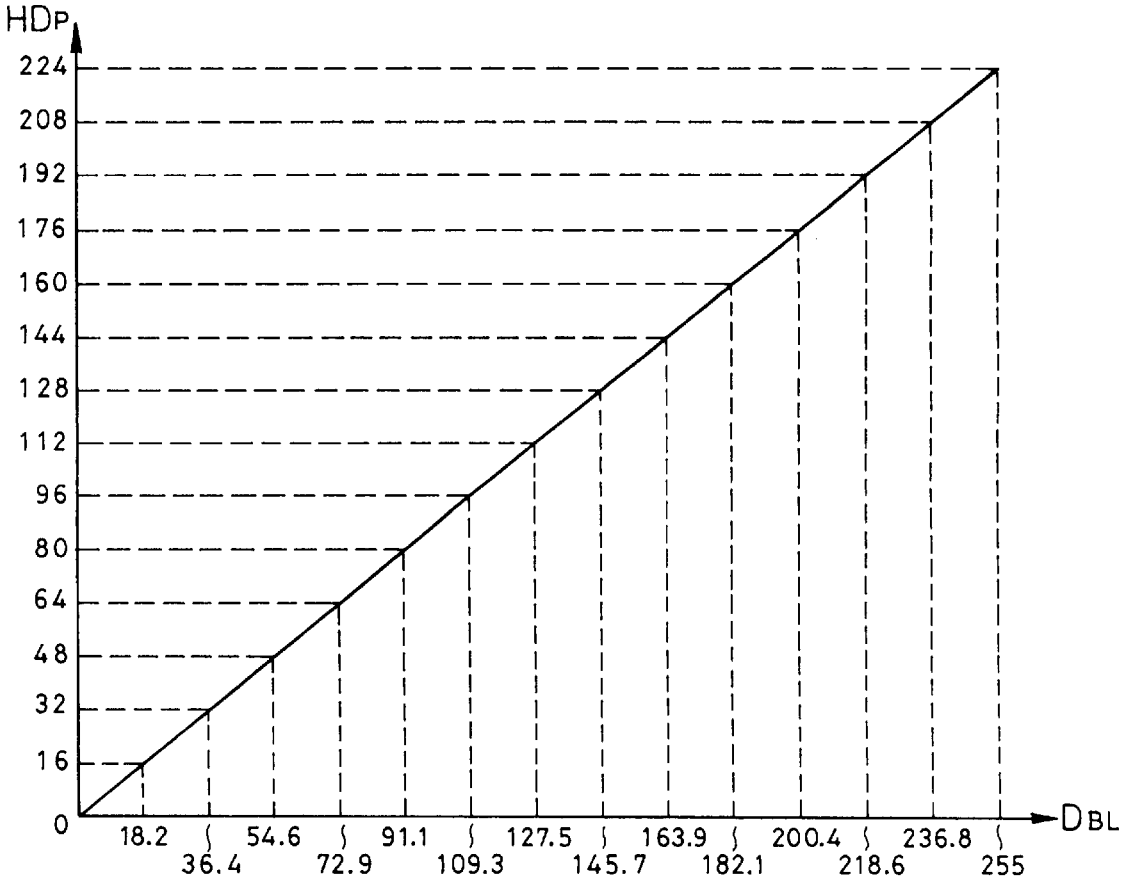
FIG. 8 is a graph illustrating a conversion characteristic in a first data converting circuit 32.

The first data converting circuit 32 in FIG. 4 converts input luminance adjusted pixel data $D_{BL}$ capable of representing 256 levels of gradation (8 bits) to 8-bit (0–244) converted pixel data $HD_P$ having the number of gradation levels reduced by 14×16/255(224/255), based on a conversion characteristic as shown in FIG. 8, and supplies the converted pixel data $HD_P$ to a multi-level gradation conversion processing circuit 33. Specifically, the 8-bit input luminance adjusted pixel data $D_{BL}$ (0–255) is converted in accordance with a conversion table as shown in FIGS. 9 and 10 based on the shown conversion characteristic. The conversion characteristic is determined in accordance with the number of bits of input pixel data, the number of compressed bits by multi-level gradation conversion, and the number of levels of gradation in display. Thus, the first data converting circuit 32 is disposed in front of the multi-level gradation conversion processing circuit 33, later described, to perform a conversion in accordance with the number of levels in gradation and the number of compressed bits by multi-level gradation conversion, to thereby divide the luminance adjusted pixel data $D_{BL}$ into a group of upper bits (corresponding to multi-level gradation pixel data) and a group of lower bits (data to be truncated, i.e., error data) on a bit boundary, and to perform the multi-level gradation conversion processing based on the multi-level gradation pixel data. This can prevent the occurrence of luminance saturation due to the multi-level gradation conversion processing, and the occurrence of flatness in the display characteristic which may be found when display gradation does not lie on the bit boundary (i.e., occurrence of gradation distortion).

As mentioned above, the group of lower bits are truncated so that the number of gradation levels is reduced, wherein the reduced portion of the gradation levels is virtually compensated for by the action of the multi-level gradation conversion processing circuit 33, later described.

Figure 11:
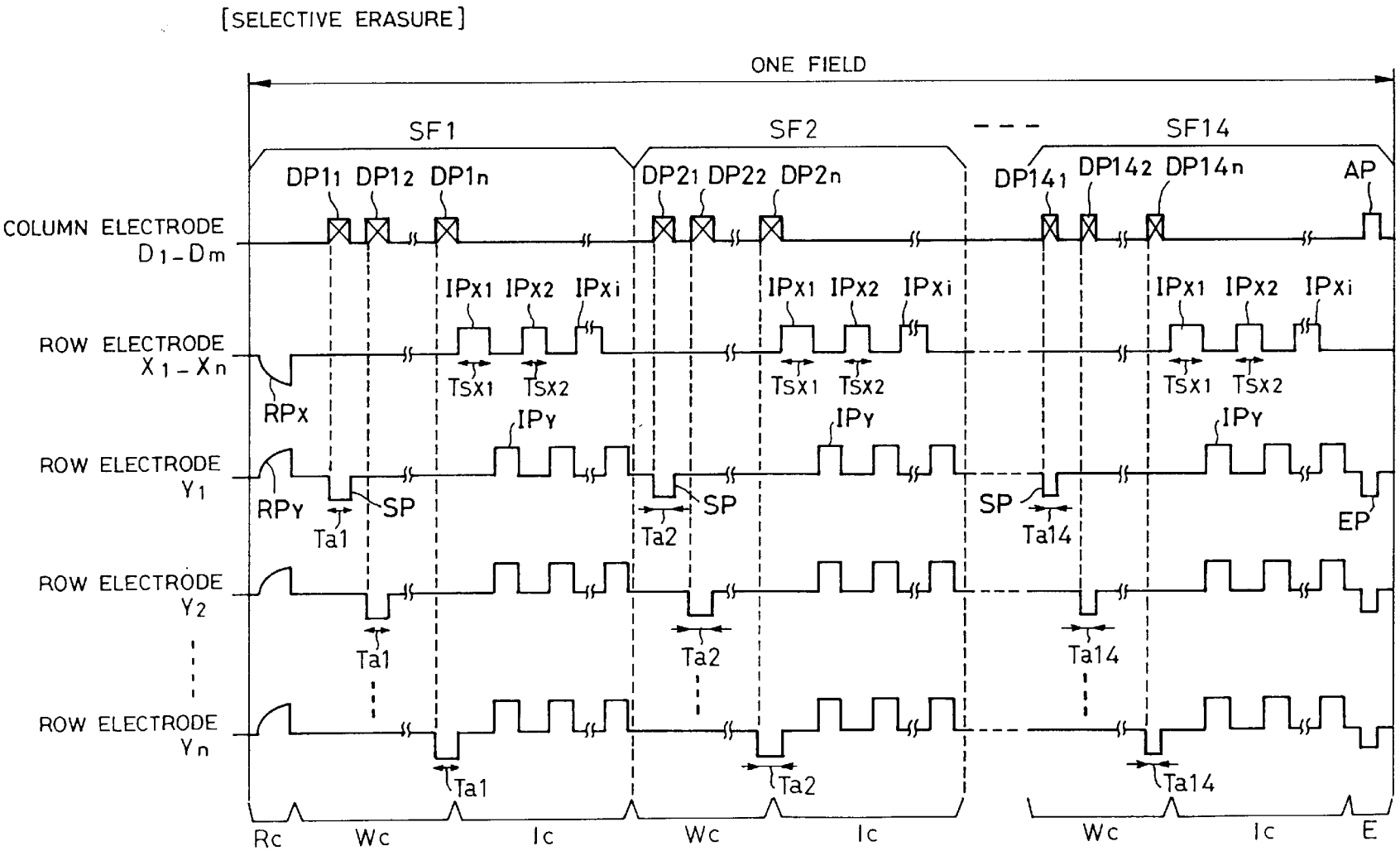
FIG. 11 is a timing chart illustrating an example of application timings for applying a variety of driving pulses to a PDP 10 in a first mode.
Figure 12:
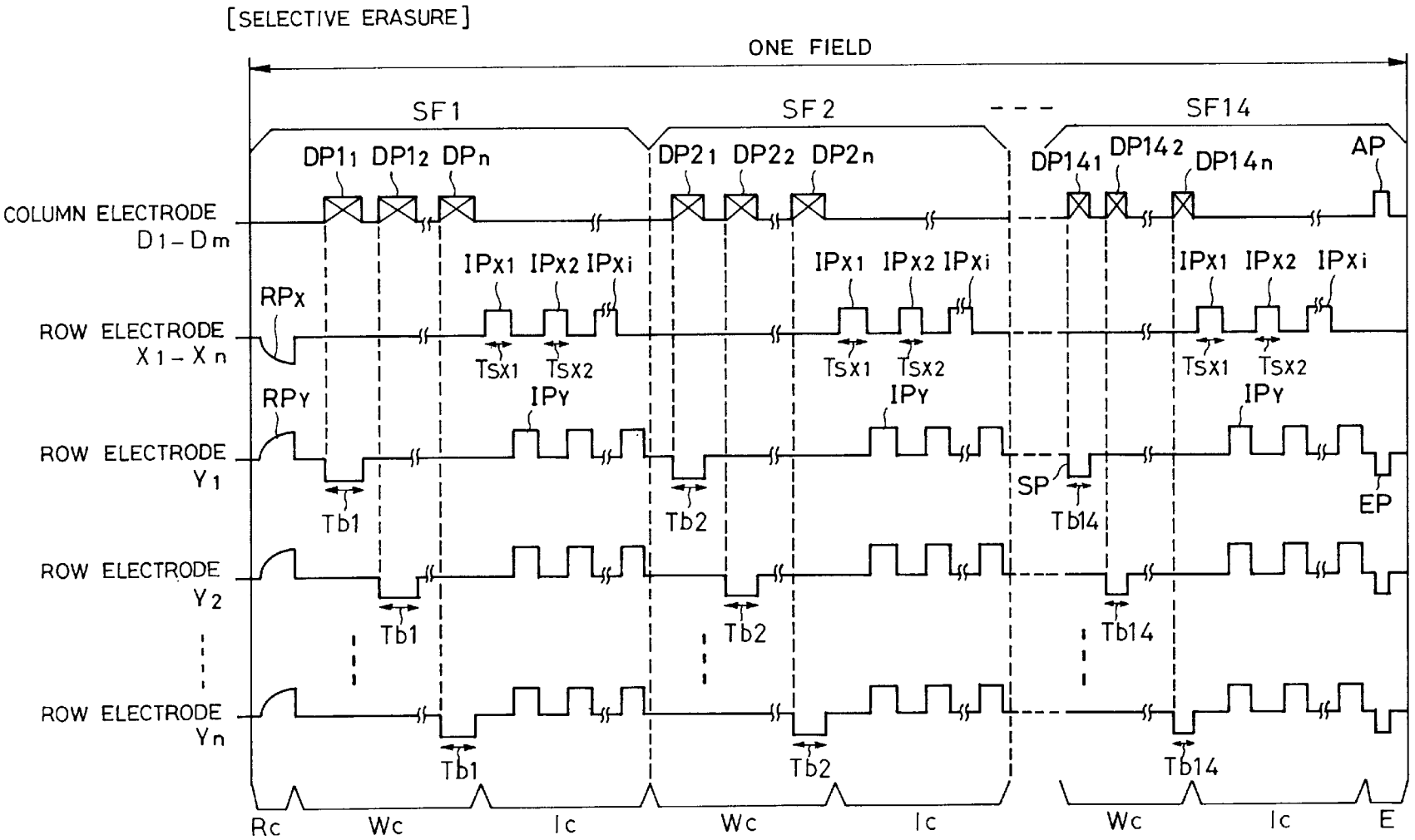
FIG. 12 is a timing chart illustrating an example of application timings for applying a variety of driving pulses to a PDP 10 in a second mode.

FIGS. 11 and 12 are timing charts illustrating timings at which each of the aforementioned address driver 6, first sustain driver 7 and second sustain driver 8 applies a variety of driving pulses to the column electrodes $D_1$–$D_m$ and the row electrodes $X_1$–$X_n$ and $Y_1$–$Y_n$ in accordance with a light emission driving format according to this embodiment.

In the example illustrated in FIG. 11, a display period of one field is divided into 14 subfields SF1–SF14, and the PDP 10 is driven in the first luminance mode. In the example illustrated in FIG. 12, on the other hand, the PDP 10 is driven similarly but in the second driving mode.

Each of the subfields SF1–SF14 includes a pixel data writing stage Wc for writing pixel data into each discharge cell of the PDP 10 to set light emitting cells and non-light emitting cells, and a light emission sustaining stage Ic for sustaining light emission only in the light emitting cells. Also, a simultaneous reset stage Rc for initializing all discharge cells in the PDP 10 is executed only in the first subfield SF1, and an erasure stage E is executed only in the last subfield SF14.

In the simultaneously reset stage Rc, the first sustain driver 7 and the second sustain driver 8 simultaneously apply each of the row electrodes $X_1$–$X_n$ and $Y_1$–$Y_n$ in the PDP 10 with reset pulses $RP_X$ and $RP_Y$ as illustrated in FIGS. 11 and 12. This causes all discharge cells in the PDP 10 to be reset or discharged to form a uniform wall charge in each of the discharge cells. Thus, all the discharge cells in the PDP 10 become light emitting cells in which a light emitting state is sustained in the light emission sustaining stage Ic, later described.

In each pixel data writing stage Wc, the address driver 6 sequentially applies the column electrodes $D_1$–$D_m$ with pixel data pulse groups $DP1_{1-n}$, $DP2_{1-n}$, $DP3_{1-n}$, . . . , $DP14_{1-n}$ on a row-by-row basis as illustrated in FIGS. 11 and 12. More specifically, in the subfield SF1, the address driver 6 sequentially applies the column electrodes $D_1$–$D_m$ with a one-row portion of a data pulse group $DP1_{1-n}$ corresponding to the first line to the nth line, generated based on the first bit of each of the converted pixel data $HD_{11-nm}$, as illustrated in FIGS. 11 and 12. Likewise, in the subfield SF2, the address driver 6 sequentially applies the column electrodes $D_1$–$D_m$ with a one-row portion of a data pulse group $DP2_{1-n}$ generated based on the second bit of each of the converted pixel data $HD_{11-nm}$, as illustrated in FIGS. 11 and 12. In this event, the address driver 6 generates a high-voltage pixel data pulse and applies the same to the column electrode D as long as the associated bit of the converted pixel data is, for example, at logical level "1." The second sustain driver 8 generates scanning pulses SP as illustrated in FIGS. 11 and 12, and sequentially applies the scanning pulses SP to the row electrodes $Y_1$–$Y_n$ at the same timing as the timing at which each pixel data pulse group DP is applied. In this event, the discharge occurs only in a discharge cell at the intersection of a "row" applied with the scanning pulse SP with a "column" applied with the high-voltage pixel data pulse (selective erasing discharge) to selectively erase a wall charge remaining in the discharge cell. The selective erasing discharge causes discharge cells, which have been initialized to the state of a light emitting cell by the simultaneous reset stage Rc, to transition to non-light emitting cells. It should be noted that the discharge does not occur in discharge cells formed on a "column" which is not applied with the high-voltage pixel data pulse, so that these cells maintain the initialized state previously formed in the simultaneous reset stage Rc, i.e., the state of light emitting cells.

Stated another way, the execution of the pixel data writing stage Wc results in alternatively setting light emitting cells which sustain the light emitting state in a light emission sustaining stage, later described, and non-light emitting cells which remains in an unlit state. Thus, the pixel data is written into each of the discharge cells.

The scanning pulse SP is generated in each of the subfields SF1–SF14 in the order of the row electrodes $Y_1$ to $Y_n$, where the scanning pulse SP has a pulse width which is the largest in the subfield SF1, gradually reduced in more subsequent subfields, and becomes the smallest in the subfield SF14. In other words, the pulse widths Ta1–Ta14 of the scanning pulse SP corresponding to the subfields SF1–SF14 have the following relationship in the first mode as illustrated in FIG. 11:

$$Ta1>Ta2>Ta3>Ta4> \ldots >Ta12>Ta13>Ta14$$

In the second mode, the pulse widths Tb1–Tb14 of the scanning pulse SP corresponding to the subfields SF1–SF14 have the following relationship as illustrated in FIG. 12:

$$Tb1>Tb2>Tb3>Tb4> \ldots >Tb12>Tb13>Tb14$$

Further, the pulse width of the scanning pulse SP in the same subfield is larger in the second mode than in the first mode. In other words, the following relationship is satisfied:

$$Tb1>Ta1,\ Tb2>Ta2,\ Tb3>Ta3,\ \ldots,\ Tb13>Ta13,\ Tb14>Ta14$$

In each light emission sustaining stage Ic, the first sustain driver 7 and the second sustain driver 8 alternately apply the row electrodes $X_1$–$X_n$ and $Y_1$–$Y_n$ with sustain pulses $IP_X$ and $IP_Y$ as illustrated in FIGS. 11 and 12. In this event, a discharge cell which still holds the wall charge formed during the pixel data writing stage Wc, i.e., a light emitting cell repeats discharge-induced light emission to sustain its light emitting state during a period in which it is applied alternately with the sustaining pulses $IP_X$, $IP_Y$. In each of the subfields SF1–SF14, the sustain pulse $IP_{X1}$ initially applied to the row electrodes $X_1$–$X_n$ has a pulse width Tsx1 larger than the pulse widths Tsx2–Tsxi of subsequent sustain pulses $IP_{X2}$–$IP_{Xi}$.

A light emission sustaining period ensured in the light emission sustaining period differs from one subfield to another as illustrated in FIG. 3. The numbers of times of light emission in the light emission sustaining stages Ic in the first mode and the second mode are as shown in FIG. 7.

Specifically, the light emission frequency ratio in the respective subfields SF1–SF14 is set nonlinear (i.e., the inverse gamma characteristic, $Y=X^{2.2}$), thereby correcting the input pixel data D for the nonlinear characteristic (gamma characteristic).

Also, as illustrated in FIGS. 11 and 12, the address driver 6 generates an erasure pulse AP which is applied to each of the column electrodes $D_1$–$D_m$ in the erasure stage E of the last subfield. The second sustain driver 8 generates an erasure pulse EP which is applied to each of the row electrodes $Y_1$–$Y_n$, simultaneously with the timing at which the erasure pulse AP is applied. Simultaneous application of these erasure pulses AP and EP causes a erasing discharge to occur in all discharge cells in the PDP 10, thereby extinguishing wall charges remaining in all the discharge cells. In other words, such erasing discharge causes all the discharge cells in the PDP 10 to become non-light emission cells.

FIG. 13 is a table showing all possible patterns of light emission driving which is conducted based on the light emission driving format as illustrated in FIGS. 11 and 12.

As illustrated in FIG. 13, a selective erasing discharge is performed for each discharge cell (indicated by a black circle) in the pixel data writing stage Wc only in one of the subfields SF1–SF14. Specifically, wall charges formed in all discharge cells of the PDP 10 by the execution of the simultaneous reset stage Rc remain until the selective erasing discharge is performed to promote discharge-induced light emission during the light emission sustaining stage Ic in each of the subfields SF which exist till then (indicated by white circles). In other words, each discharge cell functions as a light emitting cell during a period until the selective erasing discharge is performed in one field period, and continues the light emission in the light emission sustaining period Ic in each of the subfields until the selective erasing discharge in the light emission period ratio as illustrated in FIG. 3.

In this event, the number of times each discharge cell transitions from a light emitting cell to a non-light emitting cell is forced to be once or less in one field period. Specifically, this embodiment prohibits a light emission driving pattern which allows a discharge cell once set to a non-light emitting cell in one field period to return again to a light emitting cell.

Accordingly, since the simultaneous reset operation, which involves strong light emission in spite of its irrelevance to image display, need be executed only once in one field period, as previously shown in FIGS. 3, 11 and 12, it is possible to limit a degraded contrast.

Also, since the selective erasing discharge is performed once at maximum in one field period as indicated by the black circles in FIG. 13, the resulting power consumption can be reduced.

Further, as illustrated in FIG. 13, there exists no light emission pattern which presents inversion from a light emission period to a non-light emission period and vice versa in one field period, thereby making it possible to eliminate the spurious border.

The aforementioned scanning pulse SP has a pulse width which is larger in a subfield positioned earlier in the order of the subfields SF1–SF14 for the following reason. When subfields previous to a subfield in which the selective erasure operation is performed are in a light emitting state so that the light emission sustained by the discharge is sufficiently repeated (for a high luminance), sufficient priming particles exist within the discharge space to ensure that the selective erasing discharge is performed. On the other hand, when no subfield exists previous to a subfield in which the selective erasure operation is performed, or when there are only a small number of subfields which are in a light emitting state (for a low luminance where the selective erasing discharge is performed in the subfield SF1 or SF2), light emission sustained by the discharge is performed a less number of times so that sufficient priming particles do not exist within the discharge space. If a subfield involving the selective erasure operation comes over without sufficient priming particles existing within the discharge space in this way, a time delay will occur from the application of the scanning pulse SP to the triggering of actual selective erasure operation, causing an unstable selective erasing discharge and a resultant erroneous discharge during the sustaining discharge period to lead to a degraded display quality. To solve this problem, the scanning pulse SP is set such that its pulse width is larger in a subfield which is positioned earlier in the order of the subfields SF1–SF14, i.e., the pulse width of the scanning pulse SP in the first subfield SF1 (first group subfield) within one field period is set larger than the pulse width of the scanning pulse SP in the subfield SF2 (second group subfield), the subfield SF3 (third group subfield), . . . , the subfield SF14 (fourteenth group subfield) subsequent to the first subfield SF1, to initiate the selective erasing discharge without fail during the application of the scanning pulse SP, thereby making it possible to ensure a stable selective erasure operation.

Also, the scan pulse SP in the same subfield has a larger pulse width in the second mode than in the first mode for the following reason. When either the first mode or the second mode is selected in accordance with an average luminance level of input pixel data D to control the luminance by changing the number of times of light emission (the number of applied sustaining pulses) during a sustaining discharge period in the same subfield as mentioned above, the first mode is switched to the second mode when the average luminance level of the input pixel data D increases to a predetermined value or more. Since in the second mode, the light emission sustained by a discharge is performed a less number of times in the same subfield as compared with the first mode, priming particles excited by the light emission sustained by the discharge within the discharge space are reduced as compared with the first mode, causing an unstable selective erasing discharge during the pixel data writing stage and resultant erroneous discharge during the sustaining discharge period to lead to a degraded display quality. To solve this problem, the pulse width of the scanning pulse SP in each subfield is set longer in the second mode than in the first mode (i.e., a larger scan rate is set for the scanning pulse SP) to initiate the selective erasing discharge without fail during the application of the scanning pulse SP to ensure the stability of the selective erasure operation.

Figure 14:
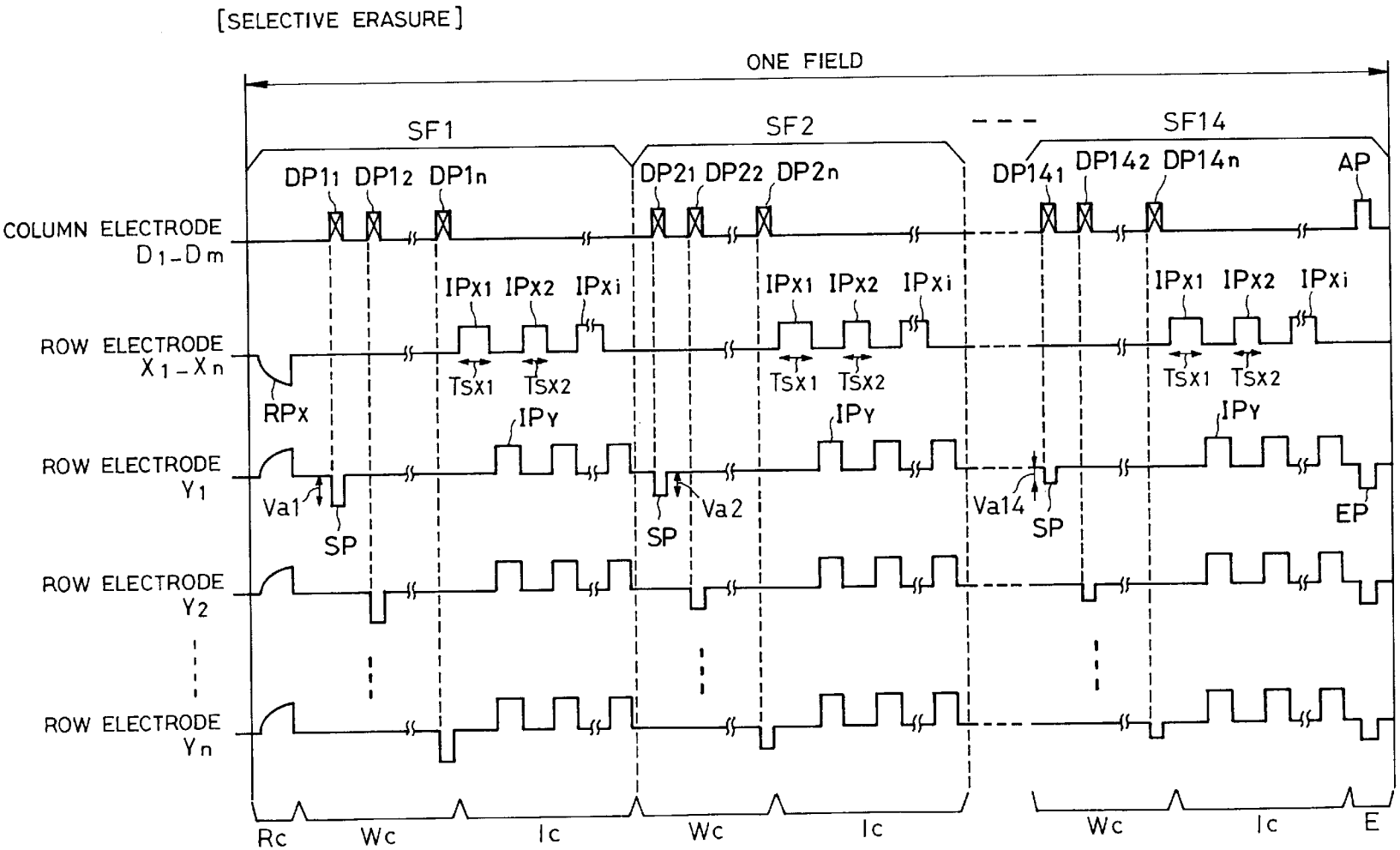
FIG. 14 is a timing chart illustrating an example of application timings for applying a variety of driving pulses to the PDP 10 in the first mode.

Alternatively, rather than varying the pulse width of the scanning pulse SP, the scanning pulse SP may be set such that its pulse voltage is larger in a subfield which is positioned earlier in the order of the subfields SF1–SF14, i.e., the pulse voltage value of the scanning pulse SP in the first subfield SF1 (first group subfield) within one field period is set larger than the pulse voltage values of the scanning pulse SP in the subfield SF2 (second group subfield), the subfield SF3 (third group subfield), . . . , the subfield SF14 (fourteenth group subfield) subsequent to the first subfield SF1. In this event, pulse voltages Va1–Va14 of the scanning pulse SP corresponding to the subfields SF1–SF14 have the following relationship in the first mode as illustrated in FIG. 14:

$$Va1>Va2>Va3>Va4> \ldots >Va12>Va13>Va14$$

Figure 15:
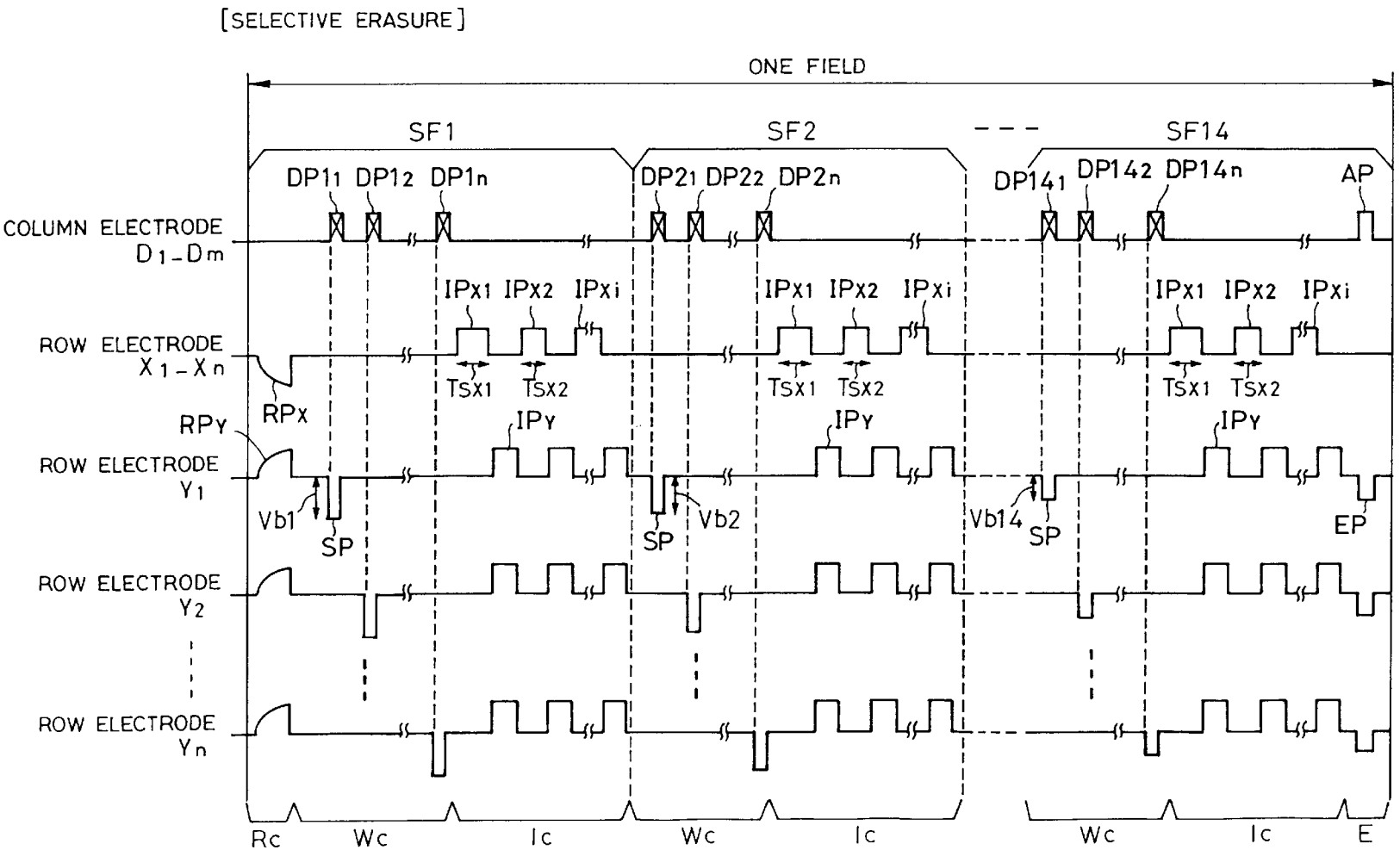
FIG. 15 is a timing chart illustrating an example of application timings for applying a variety of driving pulses to the PDP 10 in the second mode.

In the second mode, as illustrated in FIG. 15, the pulse voltage Vb1–Vb14 of the scanning pulse SP corresponding to the subfields SF1–SF14 have the following relationship:

$$Vb1>Vb2>Vb3>Vb4> \ldots >Vb12>Vb13>Vb14$$

With such setting of the pulse voltages, the voltage level of the scanning pulse SP, even in the subfields SF1 and SF2, is higher than the voltage level in any subsequent subfields, the selective erasing discharge can be initiated without fail. Further, the pulse voltage of the scanning pulse SP in the same subfield is larger in the second mode than in the first mode. In other words, the following relationship is satisfied:

$$Vb1>Va1,\ Vb2>Va2,\ Vb3>Va3, \ldots Vb13>Va13,\ Vb14>Va14$$

With the relationship thus established, the selective erasing discharge can be initiated without fail during the application of the scanning pulse SP likewise in the second mode.

Further alternatively, the scanning pulse SP may be set such that both the pulse width and the pulse voltage are larger in a subfield which is positioned earlier in the order of the subfields SF1–SF14.

Also alternatively, within a subfield group consisting of the subfields SF1–SF14, the pulse width and the pulse voltage of the scanning pulse in each subfield may be set to satisfy the following relationship:

$$Ta1=Ta2=Ta3=Ta4>Ta5=Ta6=Ta7=Ta8>Ta9=Ta10=Ta11=Ta12=Ta13=Ta14;$$

and $$Va1=Va2=Va3=Va4>Va5=Va6=Va7=Va8>Va9=Va10=Va11=Va12=Va13=Va14$$

In this event, the subfields within the subfield group consisting of SF1–SF14 are divided into a plurality of subgroups, i.e., a first subgroup consisting of SF1–SF4 including at least the first subfield; a second subgroup consisting of SF5–SF8; and a third subgroup consisting of SF9–SF14, in accordance with the pulse waveform of the scanning pulse SP in each subfield. Then, at least one of the pulse width and the pulse voltage of the scanning pulse SP in the subfields belonging to the first subgroup is set larger than the corresponding value of the scanning pulse in the subfields belonging to the second and third subgroups.

It should be noted that in the second mode in which the number of times of light emission is set smaller than in the first mode, if the pulse width of the scanning pulse SP is set longer in each subfield than in the first mode, as illustrated in FIGS. 11 and 12, this results in a longer duration of the pixel data writing period in each subfield, possibly causing difficulties in driving all the subfields within one field period. In such a situation, predetermined subfields may be removed in the second mode to reduce the number of subfields, as shown in FIGS. 16A and 16B, to prevent the driven subfields from becoming broken in the middle, which would otherwise cause a degraded display quality.

Figure 16A:
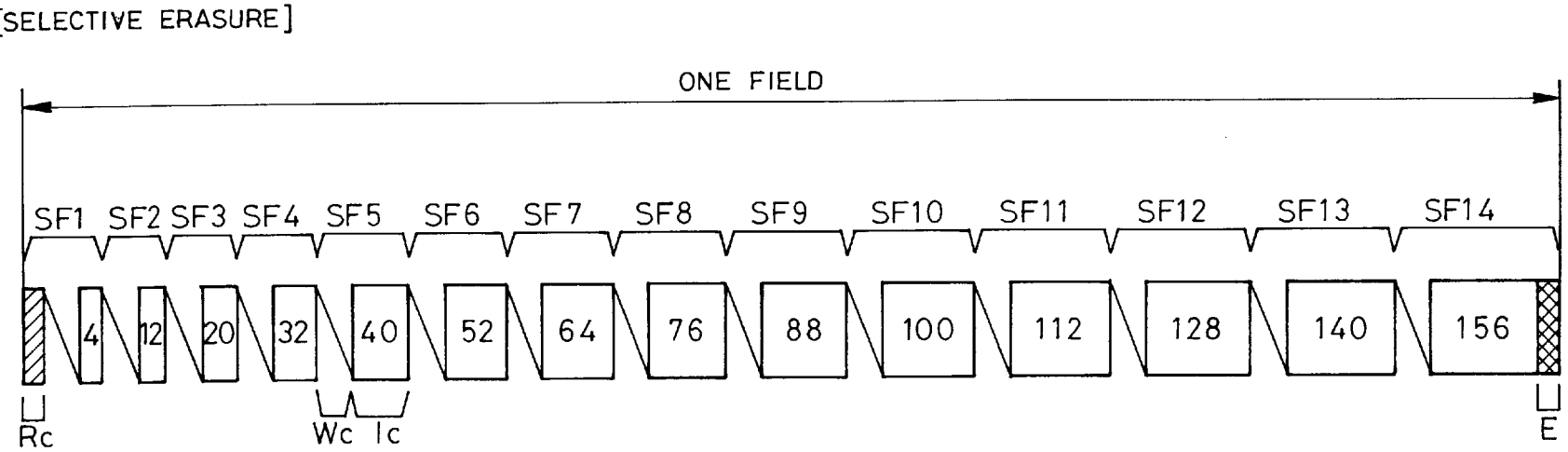
FIGS. 16A and 16B show light emission driving formats as other embodiments of the present invention.
Figure 16B:
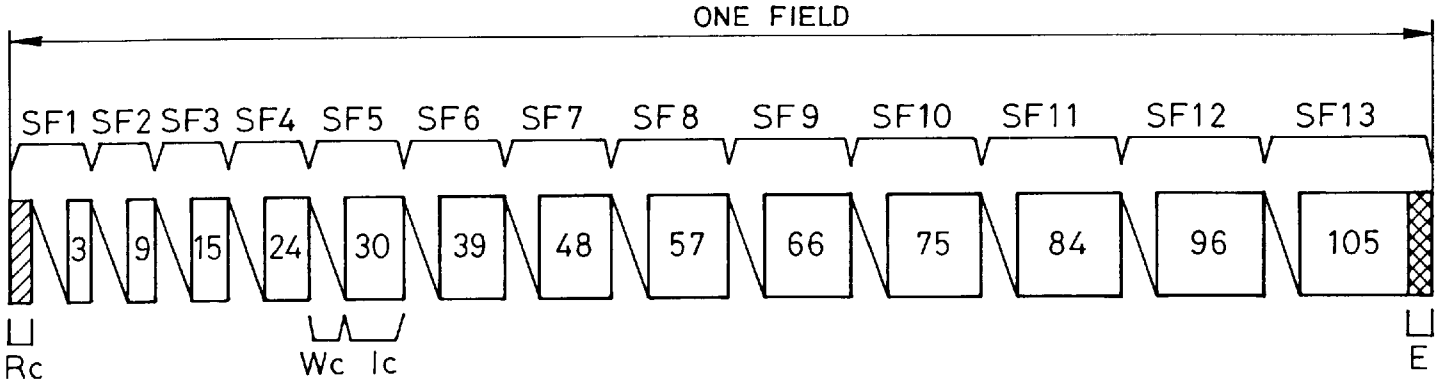

FIG. 16A shows a light emission driving format in the first luminance mode; and FIG. 16B shows a light emission driving format in the second luminance mode. As can be seen from FIG. 16A, one field consists of 14 subfields SF1–SF14 in the first mode, and the number of times of light emission in the light emission sustaining stage Ic is set to 4, 12, 20, 32, 40, 52, 64, 76, 88, 100, 112, 128, 140, 156, respectively, in the order of the subfields. On the other hand, in the second mode, one field consists of 13 subfields SF1–SF13 as shown in FIG. 16B, and the number of times of light emission in the light emission sustaining stage Ic is set to 3, 9, 15, 24, 30, 39, 48, 57, 66, 75, 84, 96, 105, respectively, in the order of the subfields. In other words, in the second mode, the light emission driving is eliminated in the subfield SF14 in which the light emission is conducted the largest number of times in the first mode.

Figure 17:
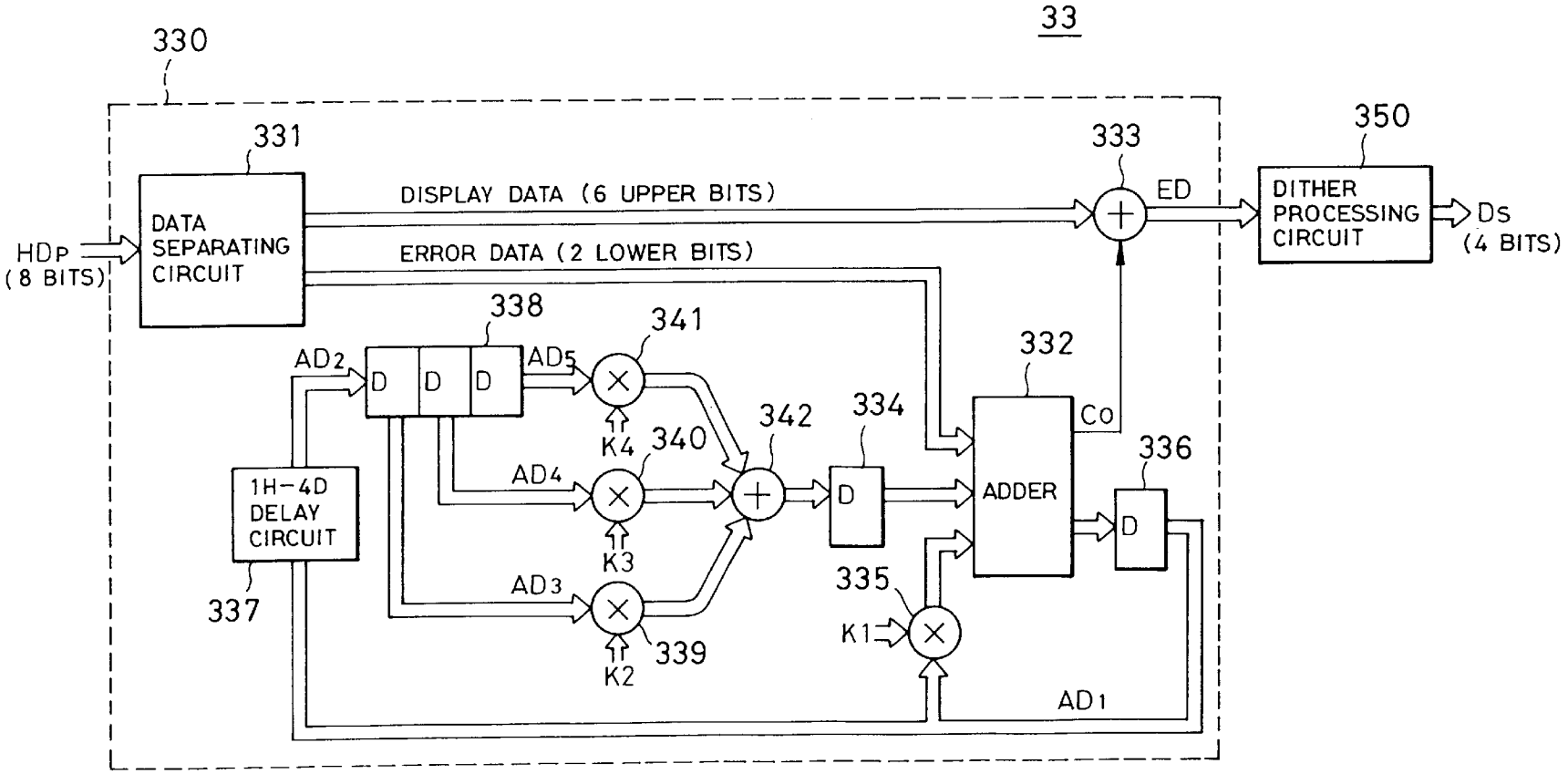
FIG. 17 is a block diagram illustrating the internal configuration of a multi-level gradation conversion processing circuit 33.

FIG. 17 details the internal configuration of the multi-level gradation conversion processing circuit 33 illustrated in FIG. 4. As illustrated in FIG. 17, the multi-level gradation conversion processing circuit 33 is composed of an error diffusion processing circuit 330 and a dither processing circuit 350.

First, a data separating circuit 331 in the error diffusion processing circuit 330 separates 8-bit converted pixel data $HD_P$ supplied from the first data converting circuit 32 into two lower bits as error data and six upper bits as display data.

An adder 332 adds the two lower bits of the converted pixel data $HD_P$ as the error data, a delay output from a delay circuit 334, and a multiplication output of a coefficient multiplier 335 to produce an addition value which is supplied to a delay circuit 336. The delay circuit 336 delays the addition value supplied from the adder 332 by a delay time D having the same time as a clock period of the pixel data to produce a delayed addition signal $AD_1$ which is supplied to the coefficient multiplying circuit 335 and to a delay circuit 337, respectively.

The coefficient multiplier 335 multiplies the delayed addition signal $AD_1$ by a predetermined coefficient value $K_1$ (for example, "7/16"), and supplies the multiplication result to the adder 332.

The delay circuit 337 again delays the delayed addition signal $AD_1$ by a time equal to (one horizontal scan period minus the delay time D multiplied by four) to produce a delayed addition signal $AD_2$ which is supplied to a delay circuit 338. The delay circuit 338 further delays the delayed addition signal $AD_2$ by the delay time D to produce a delayed addition signal $AD_3$ which is supplied to a coefficient multiplier 339. The delay circuit 338 further delays the delayed addition signal $AD_2$ by a time equal to the delay time D multiplied by two to produce a delayed addition signal $AD_4$ which is supplied to a coefficient multiplier 340. The delay circuit 338 further delays the delayed addition signal $AD_2$ by a time equal to the delay time D multiplied by three to produce a delayed addition signal $AD_5$ which is supplied to a coefficient multiplier 341.

The coefficient multiplier 339 multiplies the delayed addition signal $AD_3$ by a predetermined coefficient value $K_2$ (for example, "3/16"), and supplies the multiplication result to an adder 342. The coefficient multiplier 340 multiplies the delayed addition signal $AD_4$ by a predetermined coefficient value $K_3$ (for example, "5/16"), and supplies the multiplication result to the adder 342. The coefficient multiplier 341 multiplies the delayed addition signal $AD_5$ by a predetermined coefficient value $K_4$ (for example, "1/16"), and supplies the multiplication result to the adder 342.

The adder 342 adds the multiplication results supplied from the respective coefficient multipliers 339, 340, 341 to produce an addition signal which is supplied to the delay circuit 334. The delay circuit 334 delays the addition signal by the delay time D to produce a delayed signal which is supplied to the adder 332. The adder 332 adds the error data (the two lower bits of the converted pixel data $HD_P$), the delayed signal output from the delay circuit 334, and the multiplication output from the coefficient multiplier 335, and generates a carry-out signal $C_O$ which is at logical level "0" when a carry is not generated as a result of the addition, and at logical level "1" when a carry is generated. The carry-out signal $C_O$ is supplied to an adder 333.

The adder 333 adds the carry-out signal $C_O$ to display data (the six upper bits of the converted pixel data $HD_P$) to output the 6-bit error diffusion processed pixel data ED.

The operation of the error diffusion processing circuit 330 configured as described above will be described below.

Figure 18:
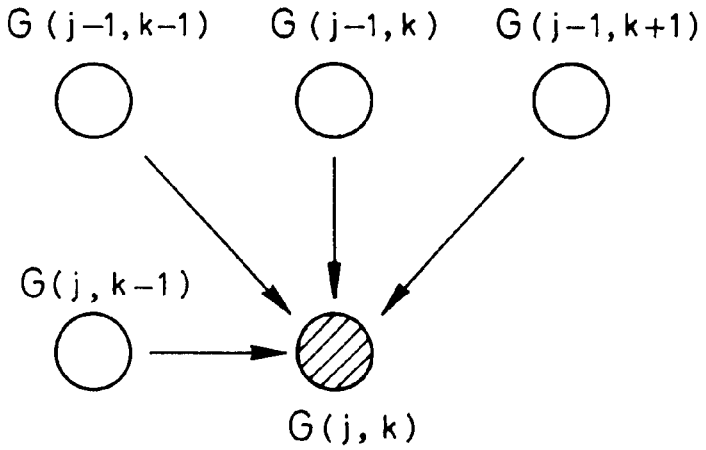
FIG. 18 is a diagram for describing the operation of an error diffusion processing circuit 330.

For producing error diffusion processed pixel data ED corresponding to a pixel G(j, k) for the PDP 10, for example, as illustrated in FIG. 18, respective error data corresponding to a pixel G(j, k−1) on the left side of the pixel G(j, k), a pixel G(j−1, k−1) off to the upper left of the pixel G(j, k), a pixel G(j−1, k) above the pixel G(j, k), and a pixel G(j−1, k+1) off to the upper right of the pixel G(j, k), i.e.:

- error data corresponding to the pixel G(j, k−1): delayed addition signal $AD_1$;
- error data corresponding to the pixel G(j−1, k+1); delayed addition data $AD_3$;
- error data corresponding to the pixel G(j−1, k): delayed addition data $AD_4$; and
- error data corresponding to the pixel G(j−1, j−1): delayed addition data $AD_5$, are weighted with the predetermined coefficient values $K_1$–$K_4$, as mentioned above, and added. Next, the two lower bits of converted pixel data $HD_P$, i.e., error data corresponding to the pixel G(j, k) is added to the addition result, and a 1-bit carry-out signal $C_O$ resulting from the addition is added to the six upper bits of the converted pixel data $HD_P$, i.e., display data corresponding to the pixel G(j, k) to produce the error diffusion processed pixel data ED.

With the configuration as described, the error diffusion processing circuit 330 regards the six upper bits of the converted pixel data $HD_P$ as display data, and the remaining two lower bits as error data, and reflects the weighted addition of the error data at the respective peripheral pixels {G(j, j−1), G(j−1, k+1), G(j−1, k), G(j−1, k−1)} to the display data. With this operation, the luminance for the two lower bits of the original pixel {G(j, k)} is virtually represented by the peripheral pixels, so that gradation representations of luminance equivalent to that provided by the 8-bit pixel data can be accomplished with display data having a number of bits less than eight bits, i.e., six bits.

If the coefficient values for the error diffusion were constantly added to respective pixels, noise due to an error diffusion pattern could be visually recognized to cause a degraded image quality.

To eliminate this inconvenience, the coefficients $K_1$–$K_4$ for the error diffusion to be assigned to four pixels may be changed from field to field in a manner similar to dither coefficients, later described.

The dither processing circuit 350 performs dither processing on the 6-bit error diffusion processed pixel data ED supplied from the error diffusion processing circuit 330 to generate multi-level gradation converted pixel data $D_S$ which has the number of bits reduced to 4 bits while maintaining the number of levels of luminance gradation equivalent to the error diffusion processed pixel data ED. The dither processing refers to a representation of an intermediate display level with a plurality of adjacent pixels. For example, for achieving a gradation display comparable to that available by 8 bits by using only upper six bits of 8-bit pixel data, four pixels vertically and horizontally adjacent to each other are grouped into a set, and four dither coefficients a–d having coefficient values different from each other are assigned to respective pixel data corresponding to the respective pixels in the set, and added. In accordance with such dither processing, a combination of four different intermediate display levels can be produced with four pixels. Thus, even with 6-bit pixel data, an available number of levels of luminance gradation are four times as much. In other words, a half tone display comparable to that provided by eight bits can be achieved with six bits.

However, if a dither pattern formed of the dither coefficients a–d were constantly added to each pixel, noise due to the dither pattern could be visually recognized, thereby causing a degraded image quality.

To eliminate this inconvenience, the dither processing circuit 350 changes the dither coefficients a–d assigned to four pixels from field to field.

Figure 19:
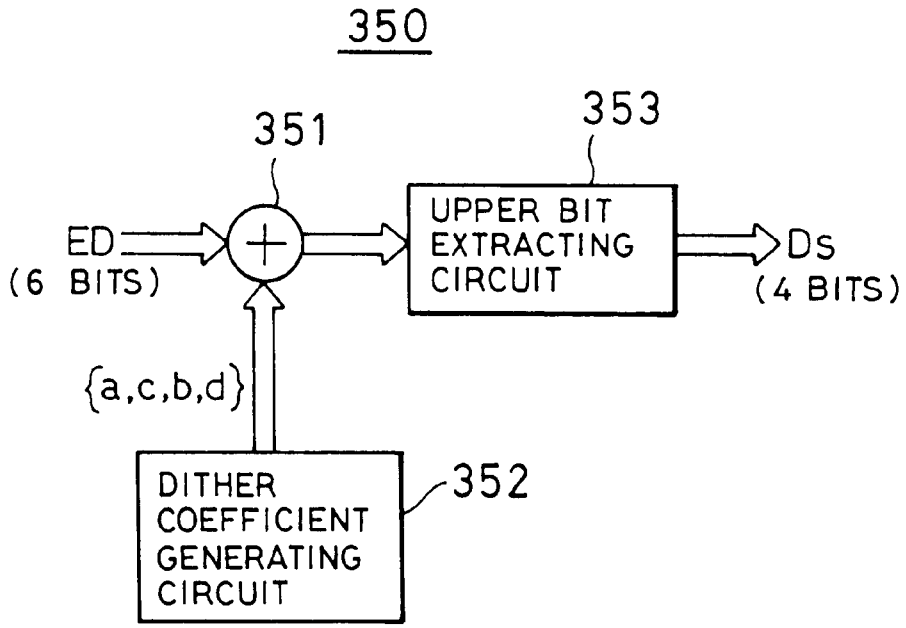
FIG. 19 is a block diagram illustrating the internal configuration of a dither processing circuit 350.

FIG. 19 is a block diagram illustrating the internal configuration of the dither processing circuit 350.

Referring specifically to FIG. 19, a dither coefficient generating circuit 352 generates four dither coefficients a, b, c, d for four mutually adjacent pixels, and supplies these dither coefficients sequentially to an adder 351.

Figure 20:
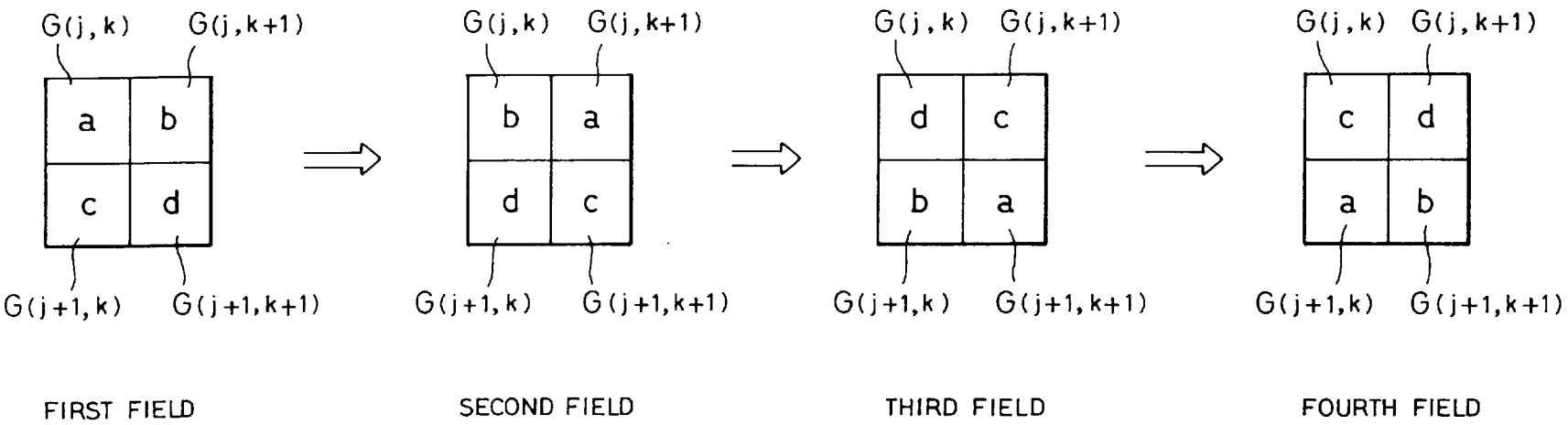
FIG. 20 is a diagram for describing the operation of the dither processing circuit 350.

For example, as shown in FIG. 20, four dither coefficients a, b, c, d are generated corresponding to four pixels: a pixel G(j, k) and a pixel G(j, k+1) corresponding to a jth row, and a pixel (j+1, k) and a pixel G(j+1, k+1) corresponding to a (j+1)th row, respectively. In this event, the dither coefficient generating circuit 352 changes the dither coefficients a–d assigned to these four pixels from field to field as shown in FIG. 20.

Specifically, the dither coefficients a–d are repeatedly generated in a cyclic manner with the following assignment:

in the first field:
pixel G(j, k): dither coefficient a
pixel G(j, k+1): dither coefficient b
pixel G(j+1, k): dither coefficient c
pixel G(j+1, k+1): dither coefficient d
in the second field:
pixel G(j, k): dither coefficient b
pixel G(j, k+1): dither coefficient a
pixel G(j+1, k): dither coefficient d
pixel G(j+1, k+1): dither coefficient c
in the third field:
pixel G(j, k): dither coefficient d
pixel G(j, k+1): dither coefficient c
pixel G(j+1, k): dither coefficient b
pixel G(j+1, k+1): dither coefficient a
in the fourth field:
pixel G(j, k): dither coefficient c
pixel G(j, k+1): dither coefficient d
pixel G(j+1, k): dither coefficient a
pixel G(j+1, k+1): dither coefficient b The dither coefficient generating circuit 352 supplies these dither coefficients to the adder 351. Then, the dither coefficient generating circuit 352 repeatedly executes the operations in the first to fourth fields as described above. In other words, upon completion of the dither coefficient generating operation in the fourth field, the dither coefficient generating circuit 352 again returns to the operation in the first field to repeat the foregoing operation.

The adder 351 adds the dither coefficients a–d assigned to each of the fields as described above to each of the error diffusion processed pixel data ED, supplied thereto from the error diffusion processing circuit 330, corresponding to the pixels G(j, k), G(j, k+1), G(j+1, k), G(j+1, k+1), to produce dither added pixel data which is supplied to an upper bit extracting circuit 353.

For example, in the first field shown in FIG. 20, the adder 351 sequentially supplies:

the error diffusion processed pixel data ED corresponding to the pixel G(j, k) plus the dither coefficient a;
the error diffusion processed pixel data ED corresponding to the pixel G(j, k+1) plus the dither coefficient b;
the error diffusion processed pixel data ED corresponding to the pixel G(j+1, k) plus the dither coefficient c; and
the error diffusion processed pixel data ED corresponding to the pixel G(j+1, k+1) plus the dither coefficient d;

to the upper bit extracting circuit 353 as the dither added pixel data.

The upper bit extracting circuit 353 extracts four upper bits of the dither added pixel data, and supplies the extracted bits to the second data converting circuit 34 illustrated in FIG. 4 as multi-level gradation converted pixel data $D_S$.

The second data converting circuit 34 converts the multi-level gradation converted pixel data $D_S$ to converted pixel data HD (display pixel data) consisting of 1st to 14th bits corresponding to the subfields SF1–SF14, respectively, in accordance with a conversion table shown in FIG. 21. The multi-level gradation converted pixel data $D_S$ is produced by reducing the number of possible gradation levels of 8-bit input pixel data D (256 gradation levels) in a ratio of 224/225 in accordance with a first data conversion (the conversion table in FIGS. 9 and 10), and converting the 8-bit input pixel data D to 4-bit data (15 gradation levels) by the multi-level gradation conversion processing, for example, such as the error diffusion processing and the dither processing, each of which compresses two bits of the 8-bit data.

Here, within the first to fourteenth bits of the converted pixel data HD, a bit at logical level "1" indicates that a selective erasure discharge is performed in a pixel data writing stage Wc in a subfield SF corresponding to the bit.

The converted pixel data HD corresponding to each discharge cell of the PDP 10 is supplied to the address driver 6 through the memory 4. In this event, the converted pixel data HD corresponding to one discharge cell must take one of fifteen patterns as shown in FIG. 21. The address driver 6 allocates the first to fourteenth bits within the converted pixel data HD to the subfields SF1–SF14, respectively, so that a high-voltage pixel data pulse is generated in the pixel data writing stage Wc in the associated subfield, as long as the assigned bit is at logical level "1." In this way, the selective erasing discharge is produced.

As described above, the data converting circuit 30 converts the 8-bit pixel data D to 14-bit converted pixel data HD to implement gradation representations of 15 levels as shown in FIG. 21. However, the operation of the multi-level gradation conversion processing circuit 33 acts to increase actually viewed gradation representations to 256 levels.

In the driving method illustrated in FIGS. 3 to 21 as described above, the simultaneous reset discharge is first produced only in the first subfield of one field period to initialize all discharge cells to light emitting cells (when the selective erasure address method is employed) or to non-light emitting cells (when the selective writing address method is employed). Next, the respective discharge cells are set to non-light emitting cells or light emitting cells in accordance with pixel data only in the pixel data writing stage in any subfield. Further, in the light emission sustaining stage in each subfield, the light emitting cells are only driven to emit light for a light emission period corresponding to the weighting for the subfield. According to this driving method, the subfields in one field are brought into a light emitting state in order from the first subfield as the luminance to be represented is increased, when the selective erasure address method is employed, whereas the subfields in one field are brought into a light emitting state in order from the last subfield as the luminance to be represented is increased, when the selective writing address method is employed.

While the foregoing embodiment performs the simultaneous reset operation once in one field period to accomplish gradation representations of 15 levels, the simultaneous reset operation may be performed twice to increase the number of gradation levels.

Figure 22:
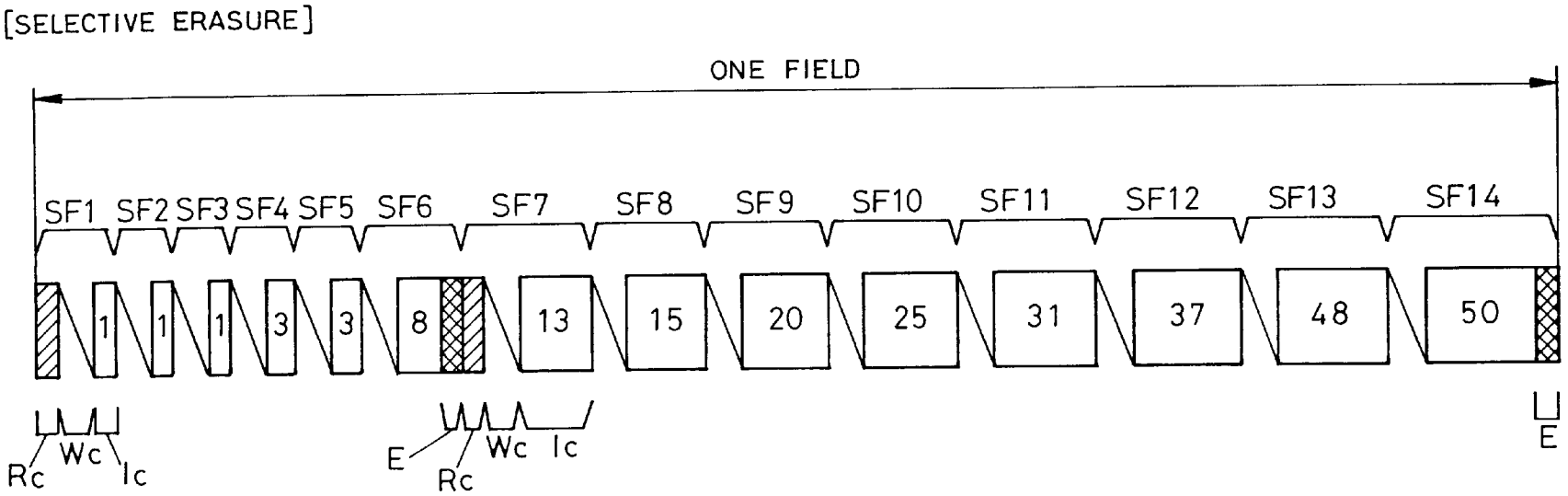
FIG. 22 shows another exemplary light emission driving format when a selective erasure address method is employed.

FIG. 22 shows a light emission driving format which is modified in view of an increased number of gradation levels. Specifically, FIG. 22 shows a light emission driving format which is applied when the selective erasure address method as described above is employed as the pixel data writing method.

In the light emission driving format shown in FIG. 22, one field period is divided into 14 subfields SF1–SF14 which are further grouped into a subfield group consisting of subfields SF1–SF6 and a subfield group consisting of subfields SF7–SF14. Each of the subfields SF1–SF14 includes a pixel data writing stage Wc for writing pixel data to set discharge cells to light emitting cells or non-light emitting cells, and a light emission sustaining stage Ic for sustaining a discharge-induced light emitting state only in the light emitting cells. In this event, a light emission period (the number of times of light emission) in each light emission sustaining stage Ic of the subfields SF1–SF14 is as follows, assuming that a light emission period in the subfield SF1 is defined as "1":

SF1: 1
SF2: 1
SF3: 1
SF4: 3
SF5: 3
SF6: 8
SF7: 13
SF8: 15
SF9: 20
SF10: 25
SF11: 31
SF12: 37
SF13: 48
SF14: 50

Specifically, the light emission frequency ratio in the respective subfields SF1–SF14 is set nonlinear (i.e., an inverse gamma ratio: $y=X^{2.2}$) to correct a nonlinear characteristic (gamma characteristic) of input pixel data D.

Further, as shown in FIG. 22, the simultaneous reset stage Rc is executed only in the first subfields SF1, SF7 of the respective subfield groups. In addition, an erasure stage E for extinguishing wall charges remaining in all discharge cells is executed in the last subfields SF6, SF14 of the respective subfield groups.

Likewise in the light emission driving format shown in FIG. 22, the pulse width and/or the pulse voltage of the scanning pulse SP is set larger in a subfield positioned earlier in each of the subfield groups SF1–SF6 and SF7–SF14, and the pulse width and/or the pulse voltage of the scanning pulse SP in the same subfield is set larger in the second mode, in which the number of times of light emission is set smaller than in the first mode, as compared with that in the first mode.

For example, the numbers of times of light emission in the respective subfields SF1–SF14 in the first mode are set to 4, 4, 4, 12, 12, 32, 52, 60, 80, 100, 124, 148, 192, 200 in the order of the subfields, whereas the number of times of light emission in the respective subfields SF1–SF14 in the second mode are set to 3, 3, 3, 9, 9, 24, 39, 45, 60, 75, 93, 111, 144, 150 in the order of the subfields.

FIGS. 23 and 24 show an example of a conversion table used in the first data converting circuit 32 illustrated in FIG. 4 when the light emission is driven based on the light emission driving format shown in FIG. 22.

The first data converting circuit 32 converts input luminance adjusted pixel data $D_{BL}$ capable of representing 256 levels of gradation (8 bits) to 9-bit (0–352) converted pixel data $HD_P$ having the number of gradation levels increased by 22×16/255 (352/255), based on a conversion table of FIGS. 23 and 24, and supplies the converted pixel data $HD_P$ to the multi-level gradation conversion processing circuit 33. The multi-level gradation conversion processing circuit 33 performs, for example, 4-bit compress processing similar to the foregoing to output 5-bit multi-level gradation converted pixel data $D_S$ (0–22).

In this event, the second data converting circuit 34 illustrated in FIG. 4 converts the 5-bit multi-level gradation converted pixel data $D_S$ in accordance with a conversion table as shown in FIG. 25 to produce 14-bit converted pixel data (display pixel data) HD.

FIG. 25 shows the conversion table and all possible light emission driving patterns used in the second data converting circuit 34 when the selective erasure address method is employed as the pixel data writing method.

In this way, when the light emission is driven as shown in FIGS. 22 to 25, gradation representations of 23 levels can be achieved with the light emission luminance levels of:

{0, 1, 2, 3, 6, 9, 17, 22, 30, 37, 45, 57, 65, 82, 90, 113, 121, 150, 158, 195, 206, 245, 256}

These luminance levels are also shown in FIG. 25.

As described above, with the driving method shown in FIGS. 22 to 25, subfields within one field period are grouped into two subfield groups, each of which consists of a plurality of subfields which are mutually successively positioned. When the selective erasure address method is employed, the subfields are grouped into a subfield group consisting of subfields SF1–SF6 and a subfield group consisting of subfields SF7–SF14, as shown in FIG. 22. In this event, the simultaneous reset stage Rc is executed only in the first subfield of each subfield group to produce a discharge for initializing all discharge cells to light emitting cells. Then, in each subfield group, the discharge cells are set to non-light emitting cells or to light emitting cells in accordance with particular pixel data only in the pixel data writing stage in any of the subfields. Further, in the light emission sustaining stage of each subfield, only the light emitting cells are driven to emit light for a light emission period corresponding to the weighting for the subfield. Thus, the simultaneous reset operation and the selective erasure operation are each performed once within each subfield group. According to this driving method, the subfields in one field are brought into a light emitting state in order from the first subfield as the luminance to be represented is increased when the selective erasure address method is employed.

In the foregoing embodiments, the scanning pulse SP and the high-voltage pixel data pulse are simultaneously applied to cause the selective erasing discharge in the pixel data writing stage Wc in any of the subfields SF1–SF14 in the driving method shown in FIGS. 3 to 21, whereas in the pixel data writing stage Wc in any of the fields SF1–SF6 belonging to the first subfield group as well as in any of the fields SF7–SF14 belonging to the second subfield group in the driving method shown in FIGS. 22 to 25.

However, if an insufficient amount of charged particles remains within discharge cells, the selective erasing discharge may not be produced normally even if these scanning pulse SP and high-voltage pixel data pulse are simultaneously applied, thereby failing to erase the wall charges in the discharge cells. In this event, the driving method shown in FIGS. 3 to 21, by way of example, may give rise to a problem in that even if A/D converted pixel data D indicated a low luminance, light would be emitted corresponding to a maximum luminance, thereby resulting in a significantly degraded image quality.

For example, if converted pixel data DH is:

[01000000000000]

when the selective erasure address method is employed as the pixel data writing method, the selective erasing discharge is performed only in the subfield SF2, as indicated by black circles in FIG. 21, to cause the discharge cells to transition to non-light emitting cells. Thus, the light emission sustaining discharge should be performed only in SF1 of the subfields SF1–SF14. However, if the selective erasing discharge fails in the subfield SF2 so that the wall discharges remain within the discharge cells, the light emission sustaining discharge will be performed not only in the subfield SF1 but also in the subsequent subfields SF2–SF14, which ends up in a display at the maximum luminance.

To solve this problem, the present invention employs a light emission driving pattern as shown in FIGS. 26 to 29 in order to further improve the stability of the selective erasure operation in the driving method of FIGS. 3–21 or FIGS. 22 to 25 to reliably prevent such an erroneous light emission operation.

FIGS. 26 to 29 show light emission driving patterns created to prevent the erroneous light emission operation as described above, and examples of conversion tables used in the second data converting circuit 34 to implement this light emission driving.

Specifically, FIGS. 26 to 28 respectively show all possible patterns for light emission driven on the basis of the light emission driving format, as shown in FIG. 3, which has the simultaneous reset stage Rc only once within one field period, and examples of conversion tables used in the second data converting circuit 34 to implement this light emission driving. It should be noted that FIGS. 26 to 28 respectively show patterns of light emission driven on the basis of the light emission format which is applied when the selective erasure address method as shown in FIG. 3 is employed.

FIG. 29 in turn shows all possible patterns for light emission driven on the basis of a light emission driving format, as shown in FIG. 22, which has two simultaneous reset stages Rc within one field period, and an example of a conversion table used in the second data converting circuit 34 to implement this light emission driving.

In the light emission driving patterns shown in FIG. 26 or FIG. 29, the selective erasing discharge is performed in succession in the pixel data writing stage Wc of each of two consecutive subfields, as indicated by black circles within the table.

According to the operation described above, even if the first selective erasing discharge fails to normally extinguish wall charges within discharge cells, the second selective erasing discharge ensures to normally extinguish the wall charges to prevent the aforementioned erroneously sustained light emission.

It should be noted that the selective erasing discharge need not be performed twice in consecutive subfields. In essence, the second selective erasing discharge may be performed in any subfield after the first selective erasing discharge has been completed.

FIG. 27 shows light emission driving patterns and an example of a conversion table used in the second data converting circuit 34.

In the example shown in FIG. 27, the second selective erasing discharge is performed one subfield after the first selective erasing discharge has been performed, as indicated by black circles in the figure.

Also, the number of times the selective erasing discharge is performed within one field period is not limited to two.

FIG. 28 shows light emission driving patterns and an example of a conversion table used in the second data converting table 34 which are created in view of variations in the number of times the selective erasing discharges may take place. Specifically, in FIG. 28, "*" indicates that the bit may be at logical "1" or "0," and a sequence of triangles indicates that the selective erasing discharge is performed continuously as long as the bit indicated by "*" remains at logical "1."

In essence, since the first selective erasing discharge possibly fails to write pixel data, the selective erasing discharge is repeated in at least one of the subsequent subfields to ensure that the pixel data is written.

As described above in detail, the method of driving a plasma display according to the present invention can improve the contrast at lower power consumption while eliminating spurious borders, and can also stabilize the selective discharge to improve the display quality.

What is claimed is:

1. A method of driving a plasma display panel to display gradation representations, said plasma display panel having row electrode pairs arranged for respective scanning lines, a plurality of column electrodes arranged intersecting with said row electrode pairs, and discharge cells, each corresponding to one pixel, formed at respective intersections of said row electrode pairs for said respective scanning lines and said plurality of column electrodes, said method comprising the steps of:

dividing one field display period into N subfields, where N is an integer number equal to or larger than two, and forming M consecutively positioned subfields within said N subfields into a subfield group, where $2 \leqq M \leqq N$ is satisfied;

executing, only in the first subfield of said subfield group, a reset stage for producing a discharge for initializing all said discharge cells into a light emitting cell state;

executing, in any subfield within said subfield group, a pixel data writing stage for applying said column electrodes with pixel data pulses to produce a discharge for setting said discharge cells to non-light emitting cells, and for sequentially applying one electrode in each of said row electrode pairs with a scanning pulse in synchronism with said pixel data pulses;

executing, in each subfield within said subfield group, a light emission sustaining stage for producing a discharge to drive only said light emitting cells to emit light a number of times corresponding to a weighting for said subfield;

selecting one from a first mode in which the number of times of light emission in said light emission sustaining stage in each subfield of said subfield group is set to a first value, and a second mode in which the number of times of light emission in said light emission sustaining stage in each subfield of said subfield group is set to a second value smaller than said first value; and setting at least one of the values of a pulse width and a pulse voltage of said scanning pulse in each subfield within said subfield group when said second mode is selected larger than the value of the pulse width or the pulse voltage of said scanning pulse in each subfield within said subfield group when said first mode is selected.

2. A method of driving a plasma display panel according to claim 1, wherein said step of selecting includes selecting first mode when an average luminance level of input pixel data is below a predetermined value, and selecting said second mode when said average luminance level becomes equal to or larger than said predetermined value.

3. A method of driving a plasma display panel according to claim 1, further comprising the step of stopping the light emission driving for the subfield having the largest number of times of light emission in said first mode when said first mode is switched to said second mode.

4. A method of driving a plasma display panel according to claim 1, wherein said pixel data writing stage includes the steps of dividing each subfield within said subfield group into a plurality of subgroups in accordance with a pulse waveform of said scanning pulse in said each subfield, and setting at least one of the values of a pulse width and a pulse voltage of said scanning pulse in a subfield belonging to a first subgroup including at least the first subfield of said subfield group larger than a respective corresponding value of said scanning pulse in a subfield belonging to another subgroup.

5. A method of driving a plasma display panel according to claim 1, wherein said pixel data writing stage is executed through the same operations in any one of subfields within said subfield group and in at least one subfield temporally subsequent to said one subfield.

6. A method of driving a plasma display panel according to claim 5, wherein said pixel data writing stage is executed through the same operations in any one of subfields within said subfield group and in the subfield immediately after said one subfield.

7. A method of driving a plasma display panel according to claim 5, further comprising the step of sustaining said light emitting cells in each of n subfields consecutive from the first one of said N subfields within said subfield group to drive said plasma display panel to display gradation representations with N+1 gradation levels, where n is a value in a range of zero to N.

8. A method of driving a plasma display panel according to claim 1, wherein said subfield group includes said N subfields.

9. A method of driving a plasma panel display according to claim 1, further comprising the step of, after executing said light emission sustaining stage in the last subfield within said subfield group, executing a stage of applying one electrode of each of said row electrode pairs with an erasure pulse for producing a discharge to set all said discharge cells to non-light emitting cells.

10. A method of driving a plasma display panel according to claim 1, further comprising the steps of forming wall charges in all said discharge cells in said reset stage, and selectively erasing said wall charges by applying said pixel data pulses and said scanning pulse in said pixel data writing stage.

11. A method of driving a display panel having row electrodes that cross column electrodes to form discharge cells, wherein the discharge cells correspond to pixels of the display panel and wherein the method comprises:

dividing one field display period into at least a first subfield and a second subfield to form at least a first subfield group, wherein the second subfield occurs after the first subfield;

executing a reset stage substantially at a beginning of the first subfield group to initialize all of the discharge cells into a first light emitting state;

applying first pixel data pulses to the column electrodes during a first pixel data writing stage in the first subfield to selectively set at least some of the discharge cells in a second light emitting state;

sequentially and respectively applying first scanning pulses to the row electrodes in synchronism with the first pixel data pulses during the first pixel data writing stage in the first subfield;

executing a first light emission sustaining stage in the first subfield in which the discharge cells having the first light emitting state emit light corresponding to weighting of the first subfield;

applying second pixel data pulses to the column electrodes during a second pixel data writing stage in the second subfield to selectively set at least some of the discharge cells in the second light emitting state;

sequentially and respectively applying second scanning pulses to the row electrodes in synchronism with the second pixel data pulses during the second pixel data writing stage in the second subfield; and executing a second light emission sustaining stage in the second subfield in which the discharge cells having the first light emitting state emit light corresponding to a weighting of the second subfield, wherein a pulse waveform characteristic of the first scanning pulses is larger than the pulse waveform characteristic of the second scanning pulses.

12. The method as claimed in claim 11, wherein the pulse waveform characteristic comprises a pulse width.

13. The method as claimed in claim 11, wherein the pulse waveform characteristic comprises a pulse magnitude.

14. The method as claimed in claim 11, wherein the display panel can be operated in a first mode and a second mode, wherein the first scanning pulses are sequentially and respectively applied to the row electrodes in synchronism with the first pixel data pulses during the first pixel data writing stage when the display panel is operated in the first mode, wherein third scanning pulses are sequentially and respectively applied to the row electrodes in synchronism with the first pixel data pulses during the first pixel data writing stage when the display panel is operated in the second mode, and wherein the pulse waveform characteristic of the third scanning pulses is larger than the pulse waveform characteristic of the first scanning pulses.

15. The method as claimed in claim 14, wherein the pulse waveform characteristic comprises a pulse width.

16. The method as claimed in claim 14, wherein the pulse waveform characteristic comprises a pulse magnitude.

17. The method as claimed in claim 14, wherein the first mode and second mode are luminance modes of the display panel, and wherein the first mode is a brighter luminance mode of the display panel than the second mode.

18. A method of driving a display panel having row electrodes that cross column electrodes to form discharge cells, wherein the discharge cells correspond to pixels of the display panel and wherein the method comprises:

dividing one field display period into at least a first subfield and a second subfield to form at least a first subfield group, wherein the second subfield occurs after the first subfield;

executing a reset stage substantially at a beginning of the first subfield group to initialize all of the discharge cells into a first light emitting state;

applying first pixel data pulses to the column electrodes during a first pixel data writing stage in the first subfield to selectively set at least some of the discharge cells in a second light emitting state;

sequentially and respectively applying first scanning pulses to the row electrodes in synchronism with the first pixel data pulses during the first pixel data writing stage in the first subfield;

executing a first light emission sustaining stage in the first subfield in which the discharge cells having the first light emitting state emit light corresponding to a weighting of the first subfield;

applying second pixel data pulses to the column electrodes during a second pixel data writing stage in the second subfield to selectively set at least some of the discharge cells in the second light emitting state;

sequentially and respectively applying second scanning pulses to the row electrodes in synchronism with the second pixel data pulses during the second pixel data writing stage in the second subfield; and executing a second light emission sustaining stage in the second subfield in which the discharge cells having the first light emitting state emit light corresponding to a weighting of the second subfield, wherein the display panel can be operated in a first mode and a second mode, wherein the first scanning pulses are sequentially and respectively applied to the row electrodes in synchronism with the first pixel data pulses during the first pixel data writing stage when the display panel is operated in the first mode, wherein third scanning pulses are sequentially and respectively applied to the row electrodes in synchronism with the first pixel data pulses during the first pixel data writing stage when the display panel is operated in the second mode, and wherein a pulse waveform characteristic of the third scanning pulses is larger than the pulse waveform characteristic of the first scanning pulses.

19. The method as claimed in claim 18, wherein the pulse waveform characteristic comprises a pulse width.

20. The method as claimed in claim 18, wherein the pulse waveform characteristic comprises a pulse magnitude.

21. The method as claimed in claim 18, wherein the first mode and second mode are luminance modes of the display panel, and wherein the first mode is a brighter luminance mode of the display panel than the second mode.

22. A display panel, comprising:

column electrodes;

row electrodes that cross the column electrodes to form discharge cells, wherein the discharge cells correspond to pixels of the display panel;

a control circuit, wherein the control circuit divides one field display period into at least a first subfield and a second subfield to form at least a first subfield group and wherein the second subfield occurs after the first subfield, wherein the control circuit executes a reset stage substantially at a beginning of the first subfield group to initialize all of the discharge cells into a first light emitting state, wherein the control circuit applies first pixel data pulses to the column electrodes during a first pixel data writing stage in the first subfield to selectively set at least some of the discharge cells in a second light emitting state, wherein the control circuit sequentially and respectively applies first scanning pulses to the row electrodes in synchronism with the first pixel data pulses during the first pixel data writing stage in the first subfield, wherein the control circuit executes a first light emission sustaining stage in the first subfield in which the discharge cells having the first light emitting state emit light corresponding to weighting of the first subfield, wherein the control circuit applies second pixel data pulses to the column electrodes during a second pixel data writing stage in the second subfield to selectively set at least some of the discharge cells in the second light emitting state, wherein the control circuit sequentially and respectively applies second scanning pulses to the row electrodes in synchronism with the second pixel data pulses during the second pixel data writing stage in the second subfield, wherein the control circuit executes a second light emission sustaining stage in the second subfield in which the discharge cells having the first light emitting state emit light corresponding to a weighting of the second subfield, and wherein a pulse waveform characteristic of the first scanning pulses is larger than the pulse waveform characteristic of the second scanning pulses.

23. The apparatus as claimed in claim 22, wherein the pulse waveform characteristic comprises a pulse width.

24. The apparatus as claimed in claim 22, wherein the pulse waveform characteristic comprises a pulse magnitude.

25. The apparatus as claimed in claim 22, wherein the display panel can be operated in a first mode and a second mode, wherein the control circuit sequentially and respectively applies the first scanning pulses to the row electrodes in synchronism with the first pixel data pulses during the first pixel data writing stage when the display panel is operated in the first mode, wherein the control circuit sequentially and respectively applies the third scanning pulses to the row electrodes in synchronism with the first pixel data pulses during the first pixel data writing stage when the display panel is operated in the second mode, and wherein the pulse waveform characteristic of the third scanning pulses is larger than the pulse waveform characteristic of the first scanning pulses.

26. The apparatus as claimed in claim 25, wherein the pulse waveform characteristic comprises a pulse width.

27. The apparatus as claimed in claim 25, wherein the pulse waveform characteristic comprises a pulse magnitude.

28. The apparatus as claimed in claim 25, wherein the first mode and second mode are luminance modes of the display panel, and wherein the first mode is a brighter luminance mode of the display panel than the second mode.

29. A display panel, which can be operated in a first mode and a second mode, comprising:

column electrodes;

row electrodes that cross the column electrodes to form discharge cells, wherein the discharge cells correspond to pixels of the display panel;

a control circuit, wherein the control circuit divides one field display period into at least a first subfield and a second subfield to form at least a first subfield group, wherein the second subfield occurs after the first subfield, wherein the control circuit executes a reset stage substantially at a beginning of the first subfield group to initialize all of the discharge cells into a first light emitting state, wherein the control circuit applies first pixel data pulses to the column electrodes during a first pixel data writing stage in the first subfield to selectively set at least some of the discharge cells in a second light emitting state, wherein, during the first mode, the control circuit sequentially and respectively applies first scanning pulses to the row electrodes in synchronism with the first pixel data pulses during the first pixel data writing stage in the first subfield, wherein the control circuit executes a first light emission sustaining stage in the first subfield in which the discharge cells having the first light emitting state emit light corresponding to a weighting of the first subfield, wherein the control circuit applies second pixel data pulses to the column electrodes during a second pixel data writing stage in the second subfield to selectively set at least some of the discharge cells in the second light emitting state, wherein the control circuit sequentially and respectively applies second scanning pulses to the row electrodes in synchronism with the second pixel data pulses during the second pixel data writing stage in the second subfield, wherein the control circuit executes a second light emission sustaining stage in the second subfield in which the discharge cells having the first light emitting state emit light corresponding to a weighting of the second subfield, wherein, during the second mode, the control circuit sequentially and respectively applies third scanning pulses to the row electrodes in synchronism with the first pixel data pulses during the first pixel data writing stage in the first subfield, and wherein a pulse waveform characteristic of the third scanning pulses is larger than the pulse waveform characteristic of the first scanning pulses.

30. The apparatus as claimed in claim 29, wherein the pulse waveform characteristic comprises a pulse width.

31. The apparatus as claimed in claim 29, wherein the pulse waveform characteristic comprises a pulse magnitude.

32. The apparatus as claimed in claim 29, wherein the first mode and second mode are luminance modes of the display panel, and wherein the first mode is a brighter luminance mode of the display panel than the second mode.

* * * * *